US012000677B2

(12) United States Patent
Baggen et al.

(10) Patent No.: US 12,000,677 B2
(45) Date of Patent: Jun. 4, 2024

(54) MODULAR UNIT OF PROTECTIVE CLOTHING, AND USE THEREOF

(71) Applicant: Blücher GmbH, Erkrath (DE)

(72) Inventors: Brigitte Baggen, Erkrath (DE); Sarah Vogt, Erkrath (DE)

(73) Assignee: BLUCHER GMBH (DE)

( * ) Notice: Subject to any disclaimer, the term of this patent is extended or adjusted under 35 U.S.C. 154(b) by 78 days.

(21) Appl. No.: 17/801,518

(22) PCT Filed: Mar. 9, 2020

(86) PCT No.: PCT/EP2020/056167
§ 371 (c)(1),
(2) Date: Aug. 22, 2022

(87) PCT Pub. No.: WO2021/164891
PCT Pub. Date: Aug. 26, 2021

(65) Prior Publication Data

US 2023/0030890 A1 Feb. 2, 2023

(30) Foreign Application Priority Data

Feb. 21, 2020 (WO) ..... PCT/EP2020/025085

(51) Int. Cl.
*F41H 1/02* (2006.01)
*A41D 13/00* (2006.01)

(52) U.S. Cl.
CPC ..... *F41H 1/02* (2013.01)

(58) Field of Classification Search
CPC ..... F41H 1/02; F41H 5/0485
See application file for complete search history.

(56) References Cited

U.S. PATENT DOCUMENTS 1,282,411 A * 10/1918 Golembowski ..... F41H 1/02 152/196
4,497,069 A * 2/1985 Braunhut ..... F41H 1/02 2/2.5
4,535,478 A * 8/1985 Zufle ..... A41D 13/0575 2/2.5
5,327,811 A * 7/1994 Price ..... F41H 1/02 89/922
5,362,527 A * 11/1994 Harpell ..... B32B 3/28 428/196
5,377,577 A * 1/1995 Bounkong ..... F41H 5/08 2/2.5
5,515,541 A * 5/1996 Sacks ..... F41H 5/0492 2/2.5

(Continued)

FOREIGN PATENT DOCUMENTS

CN 203776197 8/2014
DE 202014103530 7/2015

(Continued)

*Primary Examiner* — Robert H Muromoto, Jr.
(74) *Attorney, Agent, or Firm* — Edward E. Sowers; Brannon Sowers & Cracraft PC

(57) ABSTRACT

The present invention relates to a modular ballistic protective clothing unit, in particular with splinter, puncture and/or cut protection, preferably with splinter protection, in particular for use as protective equipment, preferably for the military and/or civilian sector, preferably for in particular subsequent application to and/or donning over an outer garment.

14 Claims, 11 Drawing Sheets

(56) References Cited

U.S. PATENT DOCUMENTS 5,754,982 A * 5/1998 Gainer ..... F41H 1/02 2/2.5
5,996,115 A * 12/1999 Mazelsky ..... F41H 1/02 2/2.5
6,263,509 B1 * 7/2001 Bowen ..... A41D 13/05 2/84
6,266,818 B1 * 7/2001 Howland ..... A41D 17/00 89/922
6,651,543 B2 * 11/2003 Park ..... F41H 1/02 89/922
6,668,868 B2 * 12/2003 Howland ..... B60C 9/18 442/205
6,745,394 B1 * 6/2004 Rutherford ..... F41H 1/02 2/466
7,216,576 B2 * 5/2007 Henry ..... F41H 5/0492 89/914
7,261,945 B2 * 8/2007 Biermann ..... B32B 9/041 428/469
D559,466 S * 1/2008 Crossman ..... D29/100
7,386,894 B2 * 6/2008 Straiton ..... F41H 1/02 2/2.5
7,571,493 B1 * 8/2009 Purvis ..... F41H 1/02 2/2.5
7,582,578 B2 * 9/2009 Heinrich ..... A62D 5/00 442/179
7,712,148 B2 * 5/2010 Carlson ..... F41H 1/02 2/2.5
7,937,780 B2 * 5/2011 Matic ..... F41H 1/02 2/465
8,201,270 B2 * 6/2012 Lee ..... A63B 71/1225 2/466
8,596,182 B2 * 12/2013 Mann ..... F41H 5/0485 89/36.11
8,671,462 B2 * 3/2014 Garcia ..... D04B 1/14 2/92
8,875,312 B2 * 11/2014 Kolmes ..... A41D 31/24 2/2.5
9,250,041 B2 * 2/2016 Howland ..... A41D 19/01505
9,265,291 B2 * 2/2016 Weber ..... A41D 13/0543
9,322,618 B1 * 4/2016 Tuttle ..... F41H 1/02
10,895,437 B2 * 1/2021 Freier ..... A41D 13/0002
10,980,293 B2 * 4/2021 Beaudry ..... A41D 13/065
11,371,807 B2 * 6/2022 Freier ..... B32B 5/024
11,466,962 B2 * 10/2022 Beck ..... F41H 1/02
2005/0015867 A1 * 1/2005 Emanuel ..... A41D 13/015 2/465
2006/0037121 A1 * 2/2006 Park ..... F41H 5/0485 2/2.5
2006/0084336 A1 * 4/2006 Howland ..... B32B 5/26 442/64
2008/0178360 A1 * 7/2008 Nascimento ..... A63B 71/1225 2/22
2009/0025126 A1 * 1/2009 Crossman ..... F41H 1/02 2/2.5
2009/0139011 A1 * 6/2009 VanErmen ..... A41D 19/0065 2/167
2010/0000001 A1 * 1/2010 Sonner ..... F41H 1/02 2/2.5
2010/0212056 A1 * 8/2010 Sullivan ..... F41H 1/02 2/2.5
2011/0271825 A1 * 11/2011 Howland ..... F41B 15/10 89/914
2012/0128947 A1 * 5/2012 Bohringer ..... A62B 17/006 428/206
2012/0159680 A1 * 6/2012 Howland ..... F41H 5/0471 2/2.5
2012/0198594 A1 * 8/2012 Reay ..... A63B 71/12 2/2.5
2012/0324612 A1 * 12/2012 Howell ..... A41D 27/10 2/2.5
2014/0237711 A1 * 8/2014 Pirone ..... F41H 3/02 2/244
2014/0331375 A1 * 11/2014 Howland ..... A41B 1/08 2/2.5
2015/0247705 A1 * 9/2015 Martinez ..... A41D 13/0153 2/2.5
2015/0247706 A1 * 9/2015 Freier ..... A41D 13/0012 2/466
2017/0176146 A1 * 6/2017 Böhringer ..... A62B 17/006
2018/0058818 A1 * 3/2018 Beck ..... F41H 1/02
2018/0188007 A1 * 7/2018 Freier ..... B32B 5/024
2019/0049222 A1 * 2/2019 Von Blücher ..... F41H 5/0492
2019/0208842 A1 * 7/2019 Gentry ..... A41D 13/0562
2019/0323800 A1 * 10/2019 Böhringer ..... A41D 31/28
2021/0363666 A1 * 11/2021 Zhou ..... D02G 3/442
2022/0323798 A1 * 10/2022 Gerhart ..... A62B 17/04
2022/0390209 A1 * 12/2022 Baggen ..... D04B 21/16
2023/0292854 A1 * 9/2023 Gill ..... A41D 13/0002 2/24

FOREIGN PATENT DOCUMENTS

DE 202017005368 12/2017
EP 1133246 3/2008
WO 0028272 5/2000

* cited by examiner

MODULAR UNIT OF PROTECTIVE CLOTHING, AND USE THEREOF

CROSS-REFERENCES TO RELATED APPLICATIONS

This application is a National Stage filing of International Application PCT/EP 2020/056167 filed Mar. 9, 2020, entitled "MODULAR UNIT OF PROTECTIVE CLOTHING, AND USE THEREOF" claiming priority to PCT/EP 2020/025085 filed Feb. 21, 2020. The subject application claims priority to PCT/EP 2020/061586 and PCT/EP 2020/025085 and incorporates all by reference herein, in their entirety.

BACKGROUND

The present invention relates to the technical field of protective equipment in the form of protective clothing, which is designed in particular for explosive ordnance disposal or clearance, both in the civilian and in the military sector, and which in particular has a splinter protection function, in particular against ballistic bodies, such as splinters, fragments or the like, which are released in particular in connection with an explosion or detonation of explosive ordnance or explosive devices, such as explosive bombs, mines or the like.

Against this background, the present invention relates in particular to a modular ballistic protective clothing unit, in particular with splinter, stab or cut protection, preferably with splinter protection, which can be used in particular as protective equipment, in particular in the military and/or civilian sector. In a preferred manner, the protective clothing unit according to the invention is suitable for subsequent application or donning (putting on) over an outer garment. According to the invention, a ballistic protection function can be provided which can be adapted to the situation, for example in the context of explosive ordnance disposal or clearance, in which there is a high risk potential of unintentional or uncontrolled explosions with corresponding explosive fragment release.

Furthermore, the present invention also relates in this context to a ballistic body protective garment as well as an upper body protective garment and also a lower body protective garment, which each have in particular splinter, stab and/or cut protection properties, preferably with splinter protection properties.

Furthermore, the present invention also relates to the use of the modular ballistic protective clothing unit according to the invention.

In addition, the present invention also relates to a method for manufacturing the modular ballistic protective clothing unit according to the invention.

The disposal of explosive, nuclear, biological or chemical ordnance on the basis of explosive devices is generally associated with a high risk of, in particular, unintentional or uncontrolled explosions or detonations, as a result of which, for example, fragments or splinters are created and released explosively. This is also accompanied by the additional risk of toxic or warfare agents being released from the explosive devices themselves or from any previously contaminated environment. This results in a high overall risk for corresponding persons who are employed, for example, in explosive ordnance disposal or clearance, such as in the detection, location and rendering harmless or clearance of explosive devices (e.g., mines or the like). In this context, controlled blasting can also be used to render explosive ordnance or explosive devices harmless or remove them, but this can also be accompanied by the release of fragments. All in all, there is a great need to protect people and emergency personnel involved in explosive ordnance disposal or clearance from the effects of splinters or fragments, especially in conjunction with protection against the release of toxic substances or similar.

In general, explosive ordnance disposal (EOD) is understood to mean the rendering harmless or removal of explosive ordnance in particular, such as explosive bombs, grenades, mines, explosive ammunition, unexploded ordnance or the like, with the aim of eliminating the (explosion) hazard posed by such ordnance. Explosive ordnance disposal generally includes all measures taken to counter the hazards posed by explosive ordnance. Explosive ordnance disposal includes appropriate procedures and approaches for the exploration, identification and evaluation, and in further steps for the rendering harmless, recovery and final disposal of unexploded ordnance, whereby corresponding secondary damage is generally to be avoided or at least minimized. In the course of explosive ordnance disposal, blasting methods or similar methods can also be used to render the corresponding explosive ordnance harmless.

In particular, the disposal of improvised explosive devices (IEDDs) poses major challenges: In this context, so-called unconventional explosive devices (also referred to as improvised explosive devices (IEDs)), such as those used in military warfare or in terrorist actions or the like, are another target of explosive ordnance disposal. Unconventional explosive devices, which equally pose a high risk potential, are also problematic from the point of view that they can often be manufactured without great technical effort or prior technical knowledge, and that they are sometimes difficult to locate and identify due to the materials used and the size and appearance (with the underlying high variability). In particular, unconventional explosive devices are sometimes highly destructive despite their often simple underlying design, which makes their removal equally problematic and dangerous.

The explosive ordnance disposal is often problematic also from there, as the explosive ordnance which can be made harmless can be present if necessary also in a problematic environment, which is loaded and/or contaminated for example with harmful and/or poisonous materials (ABC and/or CBRN poisonous materials) (with ABC=atomic, biological and chemical as well as with CBRN=chemical, biological, radioactive and nuclear [whereby the terms ABC on the one hand and CBRN on the other hand are used presently synonymously]). Besides such a chemical, biological and/or radioactive (nuclear and/or atomic) danger can proceed also from the explosive ordnance to be eliminated. In addition, such explosive ordnance can also be equipped with corresponding explosive devices or components, for example, in order to distribute the underlying toxins over a wide area, which, however, significantly increases the danger for the personnel involved in their disposal. In this context, so-called "dirty bombs" should also be mentioned in particular, in which chemical, biological or radioactive harmful or toxic substances are combined with explosive substances in a targeted manner, which represents an additional challenge in rendering such explosive ordnance harmless.

All in all, the above explanations show that persons deployed in the field of explosive ordnance disposal, such as soldiers specially trained for this purpose in the military field and equally specialized firefighters, police officers, special forces or special operations units or the like in the civilian field, are exposed to a high and diverse potential danger, so that in this respect there is a great need for corresponding protective devices, in particular in the form of protective clothing or the like, which ensure effective protection of persons deployed in the field of explosive ordnance disposal. In this context, it is also noteworthy that such persons are often in the immediate vicinity of the explosive ordnance to be removed in the course of their work, and in particular with their bodies facing the explosive ordnance to be removed. Thus, such persons are regularly located in the so-called primary explosion radius, i.e., in the immediate vicinity of the explosion site, so that in the event of an unintentional explosion, the person on duty is exposed to a high degree of explosively released (primary) fragments and often also to a high level of heat or fire (and this with a simultaneous risk of additional exposure to any toxic or warfare agents that may be present or released). Consequently, there is a very high risk of injury or even death, since, for example, splinters hitting the body at high speed and in large quantities can sometimes penetrate deep into the body, accompanied by massive destruction or injury of, among other things, physiologically important body structures such as blood vessels, nerve tracts, organs or the like.

In this context, there is, for example, a high risk of injury in the area of the frontal and lateral torso, the upper and lower extremities, the genitals as well as the urogenital tract and the lower abdomen with intestines, kidneys, spleen and liver as well as in the area of the neck and the lower head area with the in particular lower part of the face, which is not covered by a protective helmet or the like, whereby the relevant injuries can sometimes be serious or even life-threatening. In particular, there is also the risk of sometimes serious injuries to the arterial and venous system, in particular near the surface, as well as to the skin itself. Injuries to the vascular system are also problematic from the point of view that such injuries are often accompanied by correspondingly high blood loss, which is accompanied by the additional risk of bleeding to death or severe hypotension, which can be equally life-threatening for the person concerned.

Accordingly, a central requirement for the protective equipment and clothing used in explosive ordnance disposal is to provide fast and efficient ballistic protection so that the risk of injury in the event of unintentional explosions during explosive ordnance disposal in particular is reduced and the chances of survival are increased in a corresponding manner, whereby efficient fragmentation protection is also required in particular. In addition, another key requirement for appropriate protective equipment is that it should not excessively restrict freedom of movement, especially since explosive ordnance disposal requires a correspondingly high level of physical exertion while at the same time ensuring a high degree of tactility. In addition, appropriate protective equipment should be easy to put on and take off, and it should be possible to adapt it to the requirements of the underlying operational situation on a situational or individual basis (especially since an assessment of the specific hazardous situation often only occurs immediately before the operation and thus, so to speak, often only on site).

In addition, it is necessary with regard to protective equipment or clothing used in the field of explosive ordnance disposal that it can be put on and used in the state of wear or use even under non-optimal or restricted spatial conditions (for example, in destroyed buildings or impassable terrain or the like) and is easy to handle, for example, with regard to donning and doffing, whereby the greatest possible freedom of movement for the wearer of such protective equipment should also be ensured so that explosive ordnance disposal can also be carried out in an optimal manner with regard to the required tactility. In addition, one requirement for such protective systems or protective clothing is that it should be individually adaptable with regard to the protective function provided, depending on the underlying conditions of application or use, in order to ensure, so to speak, with regard to the specific use, an optimum protective function with simultaneous high freedom of movement and high wearing comfort.

However, such systems are not yet known in the state of the art. In particular, the systems known in the prior art are often not capable of meeting the aforementioned requirements to a sufficient degree.

Prior art protective equipment often provides only partial, fixed and thus not individually adaptable protection, whereby handling as well as wearing comfort and thus freedom of movement in the wearing or application state is limited. In this context, such protective equipment is often proposed in the prior art which, in order to guarantee a certain ballistic protection, has rigid or inflexible (ballistic) protective devices, for example in the form of corresponding protective plates or the like, which is also associated with a fit which is sometimes not optimal and a considerably restricted freedom of movement, so that there is also from this point of view a sometimes reduced protection, for example depending on the posture of the wearer. In addition, the protective equipment known in the prior art does not always have the required stability and durability, so that even from this point of view it is sometimes not possible to guarantee optimum protective properties.

In addition, the corresponding protective devices of the prior art do not always have optimal application properties, in particular with regard to donning and doffing, which can lead to an impediment and hindrance of the optimal or smooth course of an operation in the context of explosive ordnance disposal. In addition, the known protective devices sometimes also have poor or non-existent protection against nuclear, biological and chemical toxins and warfare agents, also due to the often inadequate possibility of using them together with standard NBC or CBRN protective equipment.

DE 2 162 701 A and U.S. Pat. No. 3,793,648 A, which belong to the same patent family, relate to an article of clothing for protection against high-energy projectiles, pockets being incorporated in the article of clothing at least in the region of the parts of the body most at risk, in which pockets plate-shaped inserts are inserted which are intended to provide increased protection against high-energy projectiles. In this context, the plate-shaped insert is to consist of a composite material of at least one metal plate and at least one layer of inorganic hard materials. Furthermore, US 2012/0180178 A1 relates to an armor device which is, for example, in the form of a vest comprising at least one armor plate.

However, systems of this type are associated, among other things, with less than optimal manageability, and the possibility of combining them with other protective equipment is also not readily available.

In summary, the devices described in the prior art do not always have optimum application and stability properties, especially with regard to the provision of special ballistic protection for explosive ordnance disposal, in which explosive ordnance in particular is to be rendered harmless or removed. In addition, the possibility of optimal adaptability with regard to the respective use or application condition is often not given to a sufficient extent. In addition, the state of the art focuses primarily on protective devices which, in terms of providing the ballistic protection function, are limited to a few predefined body sections without considering or enabling a holistic and individually adaptable or adaptive system.

Overall, therefore, there is also a great need to provide special protective systems, in particular in the form of a protective clothing unit, which, while at the same time providing a high ballistic protective function with regard to use in explosive ordnance disposal against fragments released by (unintentional) detonation or explosion, also allow a high degree of adaptability with regard to the provision of the protective function to the specific application or operational situation and can be individually adapted in this respect, whereby a high degree of wearer comfort and freedom of movement for the wearer in the case of use or application is also to be ensured.

BRIEF SUMMARY OF THE INVENTION

Against this background, the present invention is therefore based on the object of providing an efficient concept for the provision of a protective clothing unit, whereby the disadvantages of the prior art described above are to be at least largely avoided or at least mitigated.

In particular, it is an object of the present invention to provide a protective clothing unit which provides a high protective function for the protection of a wearer, in particular in the context of explosive ordnance disposal or clearance, also with respect to the provision of improved ballistic protective properties, in particular against fragments released by (accidental) detonation or explosion, such as may occur during explosive ordnance disposal or clearance.

In this context, the protective clothing unit provided according to the invention is intended to enable a high degree of situational or individual adaptability with regard to its use as ballistic protective equipment, whereby individual or adaptive ballistic protection is intended to be provided, on the one hand, in the type and size of the body areas to be protected and, on the other hand, also in the level of protection for the respective body areas to be protected, depending on the specific use or the specific application with the relevant underlying hazard situation. Thus, according to the invention, an individually adaptable protection is to be provided, which, moreover, is to be selected or adjusted accordingly without excessive expenditure of time.

In addition, a further object of the present invention is to provide a corresponding protective clothing unit which, in particular, has improved manageability when used as protective equipment in explosive ordnance disposal, especially with regard to donning and doffing the protective equipment. At the same time, the protective clothing unit provided according to the invention should also be comfortable to wear and provide a high degree of freedom of movement or mobility, whereby the tactile work performance, which plays a major role, for example, in the location and disarming of explosive ordnance ("defusing"), should not be permanently restricted. In this context, the protective clothing unit provided according to the invention should not least also have a high durability or high resistance with regard to the ballistic protection function provided.

An again further object of the present invention is to be seen also in providing a suitable ballistic protection clothing unit, which is accessible apart from the provided ballistic protection function also an ABC protection. In particular a combination possibility and/or a common use with appropriate ABC protective equipment and/or—clothing is to be made possible, whereby the functionality of the ABC protective equipment and/or clothing is not to be substantially impaired.

To solve the object described above, the present invention thus proposes—according to a first aspect of the present invention—the modular ballistic protective clothing unit, in particular with splinter, stab or cut protection, preferably with splinter protection, the protective clothing unit being suitable in particular for use as protective equipment, preferably for the military or civilian sector, in particular for subsequent application to and/or donning (putting on) over an outer garment. The protective clothing unit is particularly suitable for use as protective equipment, preferably for the military or civilian sector, preferably for subsequent attachment to and/or donning (putting on) over an outer garment; in each case, further advantageous further developments and embodiments of this aspect of the invention are the subject of the further disclosure relating to the protective clothing unit according to the invention. According to this aspect, the present invention also relates to a body protective garment and further also to an upper body protective garment and a lower body protective garment.

Furthermore, it is also an object of the present invention—according to a second aspect of the present invention—to use the modular ballistic protective clothing unit according to the invention.

Finally, it is also an object of the present invention—according to a third aspect of the present invention—to provide a method of manufacturing the modular ballistic protective clothing unit according to the invention as provided herein.

It goes without saying that in the following description of the present invention, such embodiments, advantages, examples or the like which are set forth below—for the purpose of avoiding unnecessary repetition—only with respect to a single aspect of the invention, naturally also apply accordingly with respect to the other aspects of the invention, without the need for express mention.

Furthermore, with regard to the following description of the present invention, it is also the case that the features of the present invention cited in each case in connection with the specific embodiments, advantages, examples or the like are also deemed to be disclosed in their combination. Thus, superordinate combinations of individual or several features, which are indicated for respective embodiments, examples of use or the like, are also considered disclosed herein.

Furthermore, it goes without saying that in the following statements of values, numbers and ranges, the relevant statements of values, numbers and ranges are not to be understood as limiting; it goes without saying for the person skilled in the art that, depending on the individual case or application, deviations from the stated ranges or statements can be made without leaving the scope of the present invention.

In addition, it applies that all values or parameters or the like mentioned in the following can in principle be determined with standardized or explicitly stated determination methods or otherwise with determination or measurement methods familiar to the specialist in this field. Unless otherwise stated, the underlying values or parameters are determined under standard conditions (i.e., in particular at a temperature of 20° C. and/or at a pressure of 1,013.25 hPa or 1.01325 bar).

In addition, it should be noted that in the case of all the relative or percentage, in particular weight-related, quantitative data listed below, these data are to be selected or combined by the person skilled in the art within the scope of the present invention in such a way that in total—if necessary including further components or ingredients, in particular as defined below—always 100% or 100% by weight results. However, this is self-evident for the person skilled in the art.

For the purpose of illustrating the present invention, in the following description of the objects according to the invention, recourse is also made to the reference signs indicated in the figures; the indication of the reference signs in this respect is purely illustrative and is not associated with any limitation of the objects according to the invention.

DETAILED DESCRIPTION OF THE INVENTION

Figure 1A:
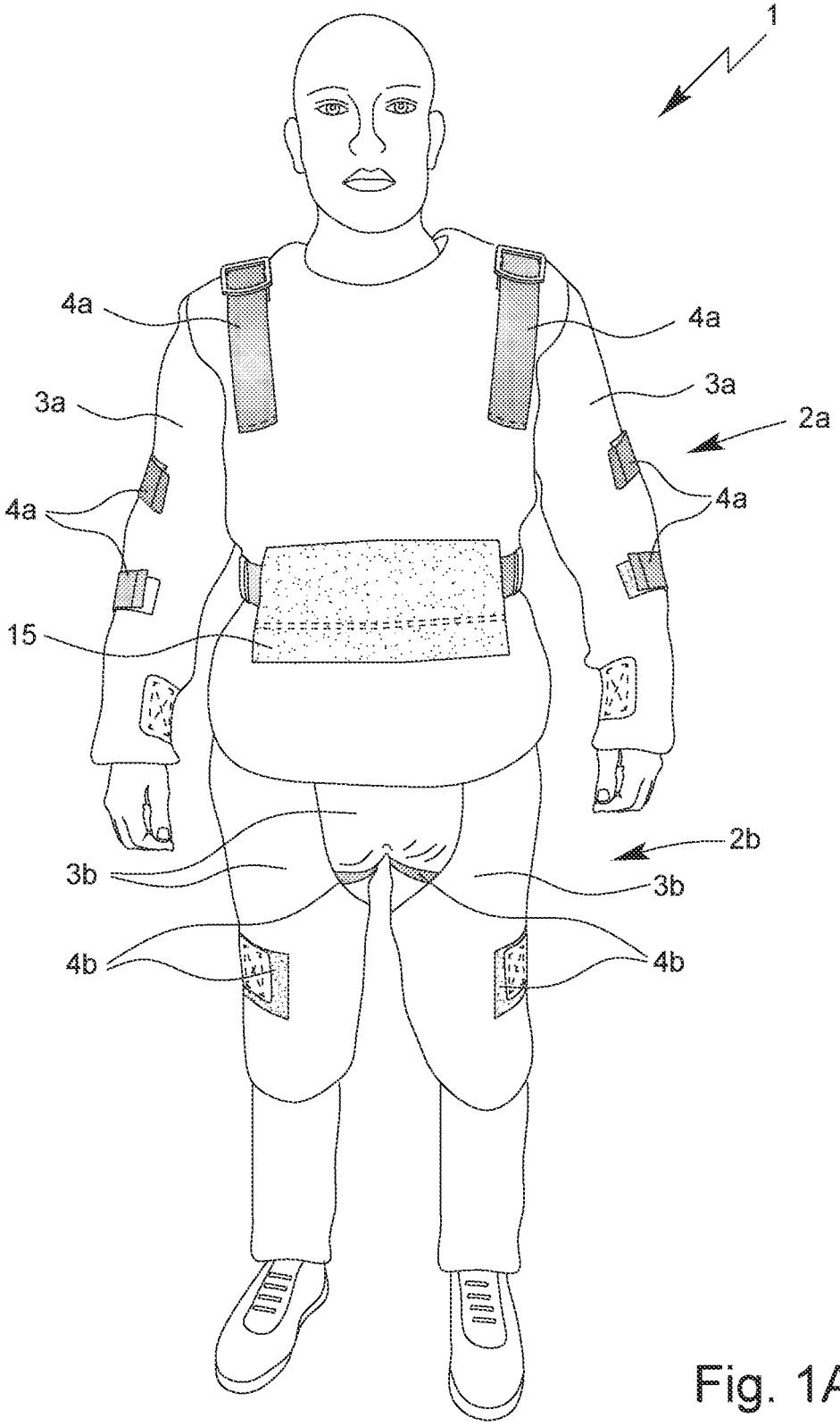
FIG. 1A provides a schematic representation showing a frontal top view of the front of a protective clothing unit according to the invention with an upper body protective garment and a lower body protective garment in the state of wear or use.

Having said this, the present invention is described in more detail below:

The object of the present invention is thus—according to a first aspect of the present invention—the ballistic protective clothing unit, in particular with splinter, stab and/or cut protection, preferably with splinter protection, in particular for use as protective equipment, preferably for the military and/or civilian sector, preferably for in particular subsequent application to and/or donning (putting on) over an outer garment, wherein the protective clothing unit comprises several, in particular at least two, preferably at least three, independent, in particular separately from each other and/or separately present, preferably mutually associated and/or mutually matched and/or mutually complementary, ballistic protective garments, in particular each with splinter, stab and/or cut protection, preferably each with splinter protection, wherein the protective garment assembly comprises at least two of the protective garments listed below:

(A) a ballistic upper body protective garment, in particular with splinter, stab and/or cut protection, preferably with splinter protection;

wherein the upper body protective garment is formed for ballistic protection of an upper body area comprising at least (A-i) the frontal (frontal) torso, (A-ii) the frontal shoulders and (A-iii) the frontal arms, wherein the upper body protective garment comprises at least one textile sheet material (upper body protective sheet material) with ballistic protection function covering the upper body area;

wherein the upper body protective garment is formed in the rear region of the torso at least regionally free of material, preferably at least substantially completely free of material; and wherein the upper body protective garment is equipped with at least one fixing element (upper body protective fixing element), preferably for in particular subsequent attachment to and/or putting on (donning) of the upper body protective garment over an outer garment, in particular jacket, in particular in the edge region of the upper body protective garment;

(B) a ballistic lower body protective garment, in particular with splinter, puncture and/or cut protection, preferably with splinter protection;

wherein the lower body protective garment is designed for ballistic protection of a lower body region comprising at least (B-i) the front upper legs (thighs), optionally (B-ii) the front hip and optionally (B-iii) the genital region, wherein the lower body protective garment comprises at least one textile sheet material (lower body protective sheet material) with ballistic protection function covering the lower body region;

wherein the lower body protective garment is formed in the rear region of the upper legs at least regionally free of material, preferably at least substantially completely free of material; and wherein the lower body protective garment has at least one fixing element (lower body protective fixing element) in the rear region of the upper legs, preferably for, in particular, subsequent attachment to and/or putting on (donning) of the lower body protective garment over an outer garment, in particular trousers;

and (C) at least one ballistic neck and/or head protective garment, in particular with splinter, stab and/or cut protection, preferably with splinter protection, wherein the neck and/or head protective garment is designed for ballistic protection of a neck and/or head region, which comprises at least (C-i) the neck in particular on the front side and/or (C-ii) the head, wherein the neck and/or head protective garment has at least one textile sheet material (neck and/or head protective sheet material) with ballistic protective function, which covers the neck and/or head region.

A central idea of the present invention is to be seen in particular in the fact that with regard to the protective clothing unit according to the invention, an individual ballistic protection is provided which is adapted to the respective conditions of use or application or circumstances, both with regard to the type or size (e.g., torso, arms, legs, etc.) and also with regard to the specific protective strength provided in this respect. The protective clothing according to the invention is particularly suitable for use in the context of explosive ordnance disposal or clearance for the protection of a person on duty or a wearer of the protective clothing unit according to the invention.

According to the invention, a modular concept is also provided, according to which various items of clothing can be individually formed and combined. Due to the modular design of the protective clothing unit according to the invention, a ballistic protection which can be adapted to the situation can be provided, both with regard to the scope or selection of the body areas to be protected and with regard to the strength of the underlying ballistic protection provided for a specific body area. With regard to the present invention, the respective components of the protective clothing unit according to the invention, namely the upper body protective garment, the lower body protective garment as well as the neck or head protective garment can be individually combined with each other, whereby in this respect a mutually associated or complementary ballistic protection is provided, whereby with regard to the underlying source of danger in the form of the explosive ordnance or the like in a corresponding manner, for example, even a ballistic full body protection can be provided.

Within the scope of the present invention, a further individualization of the protection provided can also be seen in the high variability of the components underlying the protective clothing unit according to the invention in the form of the upper body protective garment, the lower body protective garment and the neck or head protective garment, according to which special and adapted cutting can be used to protect special body areas and according to which corresponding protective zones can be individually formed with regard to their protective strength. As stated in detail below, the ballistic protection strength for respective protection zones or areas of the protective clothing unit can be adapted or individually adjusted within the scope of the present invention, for example, by a special design and arrangement of underlying ballistic protective materials and further by additional use of ballistic protection elements which are not permanently installed or which can be individually retrofitted and thus supplemented, so that there is also from this point of view a high degree of individual or situational adaptability with regard to the provision of adaptive ballistic protection. According to the invention, there is therefore also individually adaptable or tailorable ballistic protection.

The protective clothing unit according to the invention is also characterized by excellent manageability, in particular with regard to donning and doffing ("putting on" and "taking off"), so that the protective clothing unit according to the invention can be fitted quickly and safely in the event of a hazardous situation, which represents a further important safety aspect for persons on duty. The modular structure of the protective clothing unit according to the invention is also of great importance here in that the underlying components in the form of the upper body protective garment, the lower body protective garment and/or the neck or head protective garment are present as independent protective garments, in particular separately from one another or separately present, which as such are matched to one another or complement one another. The modular structure of the protective clothing unit according to the invention, according to which the underlying components in the form of the above-mentioned garments are not firmly connected to one another, results not only in individual adaptability with regard to the protective function and excellent manageability, but also in significantly improved wearing comfort. The protective clothing unit according to the invention therefore also exhibits a high level of wearer comfort in the state of wear or use, while at the same time ensuring a high degree of freedom of movement. This also ensures a high tactile working performance for the benefit of the wearer, so that the protective clothing unit according to the invention is particularly suitable for such areas of application, namely for example in the context of explosive ordnance disposal or—clearance, in which highly tactile working is required. For this reason, too, the protective clothing unit according to the invention has a high safety-specific aspect.

In the context of the present invention, the high level of wearing comfort and the guarantee of a high degree of tactility are ensured not least by the fact that the protective clothing unit according to the invention is designed to be flexible or bendable overall on account of its basic textile structure (which further benefits the freedom of movement). In addition, as a result of the use of textile components to provide the ballistic protection function, the protective clothing unit according to the invention also has a low overall weight or weight per unit area, so that there is also less physical stress on a person in action in this respect, so that no premature exhaustion occurs.

In addition, within the scope of the present invention, a high level of wearer comfort is also achieved by the fact that the protective clothing unit according to the invention or the underlying items of clothing is/are designed to be free of material, at least in some areas or sections, and also to be permeable to air or water vapor, if necessary. This ensures effective removal of moisture (e.g., body perspiration) and optimum heat exchange.

Due to the excellent manageability, the protective clothing unit according to the invention can be put on within a short time or without delay and, as it were, spontaneously immediately before an operation, and this also under less than optimal spatial conditions, for example in confined spaces or the like, and taking into account the concretely present hazard potential, which may only be determined on site.

As far as the protective clothing unit according to the invention is concerned, it is worn, as it were, in particular as the outermost protective equipment or clothing over an outer garment arranged underneath or lying underneath. In this context, improved manageability with respect to the donning and doffing of the protective clothing unit according to the invention is also ensured by the fact that the protective clothing unit in the context of the present invention, as will be indicated below, is also not firmly connected to the outer clothing lying underneath, but rather is attached by independent fixing elements, as it were loosely or unconnected, to the outer clothing in the form of an outer garment. This not least also improves the safety at work, since the fixing elements ensure a firm hold or a firm positioning in the state of wear or use, so that slipping or displacement of the protective clothing unit is effectively counteracted.

As a result of the conception according to the invention and the underlying modularity of the ballistic protective clothing unit, not least also a simple combination with outer clothing, in particular in the form of NBC protective clothing or the like, can be made, so that in the context of the conception according to the invention in particular application or mission-dependent combined protective properties are provided, namely ballistic protective properties on the one hand and protective properties against nuclear, biological or chemical toxins or warfare agents on the other hand. This also further increases the safety of personnel in action, since a wide range of protection is also provided.

Due to the conception according to the invention, according to which no fixed connection of the protective clothing unit according to the invention with the underlying outer clothing is provided, there is also a high overall variability with regard to the type and design of the underlying outer clothing so that the outer clothing arranged under the protective clothing unit according to the invention in the wearing state can be equally individually designed or equipped with a variety of individual properties.

The protective clothing unit according to the invention with the clothing items on which it is based is thus an independent unit that is independent of the outer clothing underneath in the state of wear or use. The fact that the protective clothing unit can be put on or handled separately, so to speak, independently of an underlying outer garment which may, for example, be equipped with an NBC protective function, means that in the case of use or deployment, for example, a corresponding outer garment with NBC protective function can be worn permanently, so to speak, and supplemented with the ballistic protective clothing unit according to the invention in the specific case of use or need. This makes possible thus a durable and during the employment and/or the employment preparation uninterrupted ABC protection (and also when putting on and taking off the protective clothing unit), which is for example of large importance, if appropriate work must be accomplished in an area with if necessary existing ABC contamination.

Not least because of the special properties and advantages mentioned above, the protective clothing unit according to the invention is particularly suitable for use in the field of explosive ordnance disposal or clearance, for example in bomb disposal or mine detection or the like. In particular, the protective clothing unit according to the invention is also suitable for use in the rendering harmless or removal of chemical explosive ordnance with an assumed risk of explosions with the associated release of fragments or splinters.

In this context, a further idea of the present invention is also that the ballistic protection is provided in particular for the area of the body facing the source of danger, such as an explosive ordnance or an explosive device or the like, in particular the front or front side, during use or application, while areas free of material are provided for the side or rear side of the body facing away from the source of danger, which benefits both manageability and wearing comfort overall, as previously indicated.

Within the scope of the present invention, a protective clothing unit with reduced overall weight due to the special construction and matching of the underlying clothing items is thus provided overall, and thus an overall lightweight protective system which is particularly suitable for providing a further protective function within the scope of a combat agent removal or clearance and thus as an EOD protective system. In this context, the ballistic protective clothing unit according to the invention can be used, for example, for use in the conduct, investigation or survey, vegetation clearance, detection and clearance or rendering harmless of explosive ordnance or explosive devices from which an NBC hazard can also emanate. In particular, the ballistic protective clothing unit according to the invention can be used, for example, in mine detection and other demining activities. In this context, the ballistic protective clothing unit offers, in contrast to the overall heavyweight and relatively rigid bomb suits of the prior art, an upgradeable and individually adjustable ballistic protection solution, which provides protection, in particular from the front, facing the source of danger, in a target- and purpose-oriented manner, while at the same time being highly flexible and significantly reducing the physical strain on the wearer of such a protective clothing unit.

In particular, the ballistic protective clothing unit according to the invention can provide fast and flexible equipment for providing ballistic protection for highly sensitive areas of a wearer's body on the basis of the underlying special clothing items in the sense of a modular system. In this context, the quick and easy donning and doffing of the garments and thus of the protective clothing unit as a whole underscores the ease of handling and the individual adaptability or upgradability with regard to the underlying situation with the related hazard potential.

In summary, in addition to simplified attachment and removal, a secure and non-slip fit of the protective clothing unit is ensured, which further increases the underlying application safety.

The term "fragment protection" as used in the context of the present invention is to be understood very broadly and refers in particular to the provision of a protective function against the penetration or ingress of ballistic bodies or projectiles released directly or indirectly by detonation or explosion, in particular in the form of fragments or splinters. The invention is based on the use of a special material for the penetration or penetration of ballistic bodies or projectiles released directly or indirectly by detonation or explosion, in particular in the form of fragments, which are characterized in particular by different particle sizes and by an irregular shape and which, for example, are released explosively in the form of primary or secondary fragments during the detonation of explosive devices or the like and can strike the person exposed to a detonation with high velocity or kinetic energy, for example in the context of an unintentional or uncontrolled but also a controlled detonation or explosion during the removal or clearance of explosive ordnance. According to the invention, the terms "fragments" on the one hand and "fragments" on the other hand are used synonymously in this context. Furthermore, according to the invention, the terms "stab protection" and "cut protection" are to be understood very broadly, whereby the aforementioned terms refer in particular to the further provision of a protective function against the (force) effect of pointed or sharp objects, in particular so that, according to the patent in suit, further protection is thereby provided.

The term "front side" (synonymously also referred to as "forward side"), as used in the context of the present invention, in particular for the assignment or selection of certain body areas or sections with regard to the provision of splinter, puncture or cut protection, in particular ballistic protection, by the protective clothing unit according to the invention or of the garments on which it is based is to be understood very broadly in the context of the present invention as a whole, and refers in particular to the body sections or areas assigned to the front or front side of the body of a wearer or to those arranged on the front or front side of the body of a wearer, i.e. to those which face a source of danger in the state of wear or use. In this context, it applies for example to the frontal area of the arms, in particular that this results illustratively in particular from a natural, in particular drooping posture of the arms (according to which the palms are oriented towards the body or thigh) and the associated frontal view. In this context, the frontal area of the arms thus refers illustratively in particular to the area of the biceps or flexor of the upper arm as well as the area of the forearm starting from the bending area of the elbow joint in the direction of the thumb of the hand. Further, by way of example and illustration, the term "anterior" refers in particular to the anterior region of the extensor muscles with respect to the upper legs and to the region of the tibia with respect to the lower leg.

Furthermore, the term "lateral" as used in the context of the present invention, in particular for the assignment of certain body areas or sections with regard to the provision of the protective function by the ballistic protective clothing unit according to the invention or the garments on which it is based, is also to be understood very broadly overall in the context of the present invention. In particular, the term in question refers, by way of example and illustration, to the areas or sections of the body adjacent to the frontal areas or sections of the body (on both sides). For the case of the extremities, the term "lateral" thus refers in particular to the corresponding inner and outer sides of the extremities to be used.

In addition, the term "backside" as used in the context of the present invention, in particular for the assignment of specific body areas or sections with regard to the provision of the protective function by the ballistic protective clothing unit according to the invention or the garments on which it is based, is also to be understood very broadly overall in the context of the present invention. In particular, the term in question refers to the present body areas or sections localized in the area of the back of the body of a wearer. For the case of the arms, by way of example and illustration, the term "back side" refers, with respect to the upper arm, more particularly to the area of the triceps or extensor, and with respect to the forearm, more particularly to the area from the extensor side of the elbow joint toward the little finger of the hand.

With regard to the term "free of material" used in accordance with the invention, this is generally to be understood equally broadly. In particular, the term in question refers to the fact that the underlying areas are at least substantially free of any materials as such of the protective clothing unit and thus in particular free of the textile sheet material with ballistic protective function, and in particular with the provision, that in the material-free areas at most the fixing elements provided in accordance with the invention (with possibly further devices which substantially concern the fixing elements themselves, such as textile sheathing, padding or the like) are arranged to extend (in particular in order to thereby at least substantially protect the corresponding items of clothing of the protective clothing unit according to the invention in the state of wear or use in an at least substantially slip-proof in position). This also facilitates donning and doffing, namely in particular to the extent that the respective upper body protection or lower body protection garments can be put on from the front, as it were, and secured via corresponding fixing elements.

Furthermore, as far as the in particular relative arrangement or positioning indications of the protective clothing unit according to the invention or of the underlying garments are concerned, these refer in particular to the body of a wearer of the protective clothing unit or of the underlying garments and thus in particular to the state of wear or use of the protective clothing unit according to the invention or of the garments on which it is based.

In the following, the present invention will be explained in more detail with reference to preferred examples of embodiments or embodiments representing drawings or figure representations. In connection with the explanation of these preferred embodiments of the present invention, which are, however, in no way limiting with respect to the present invention, further advantages, properties, aspects and features of the present invention are also pointed out.

Figure 1B:
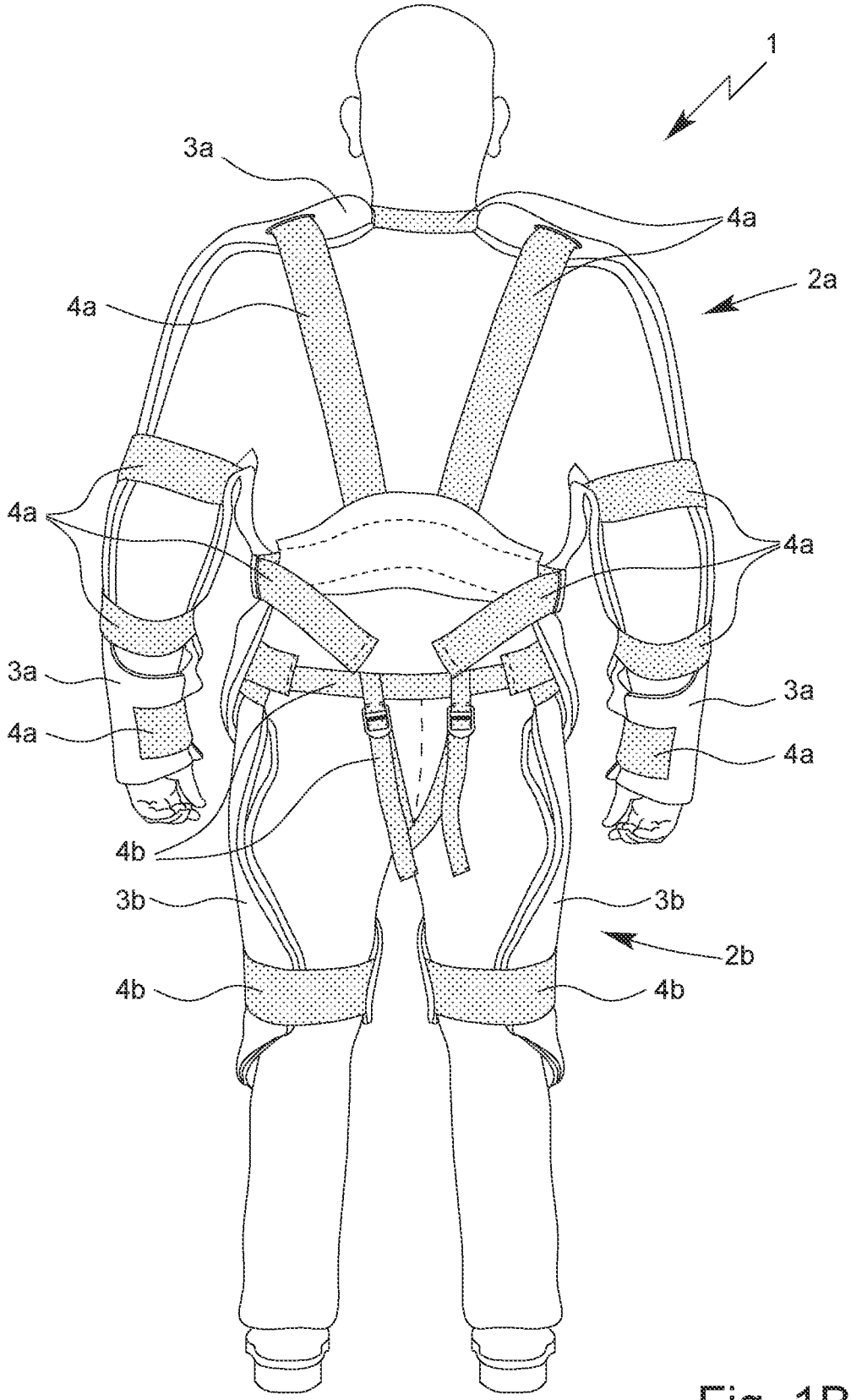
FIG. 1B provides a schematic representation corresponding to FIG. 1A with a rear side top view of the rear side of the protective clothing unit according to the invention as shown in FIG. 1A in the wearing or application state with the rear side arrangement of fixing elements.
Figure 2A:
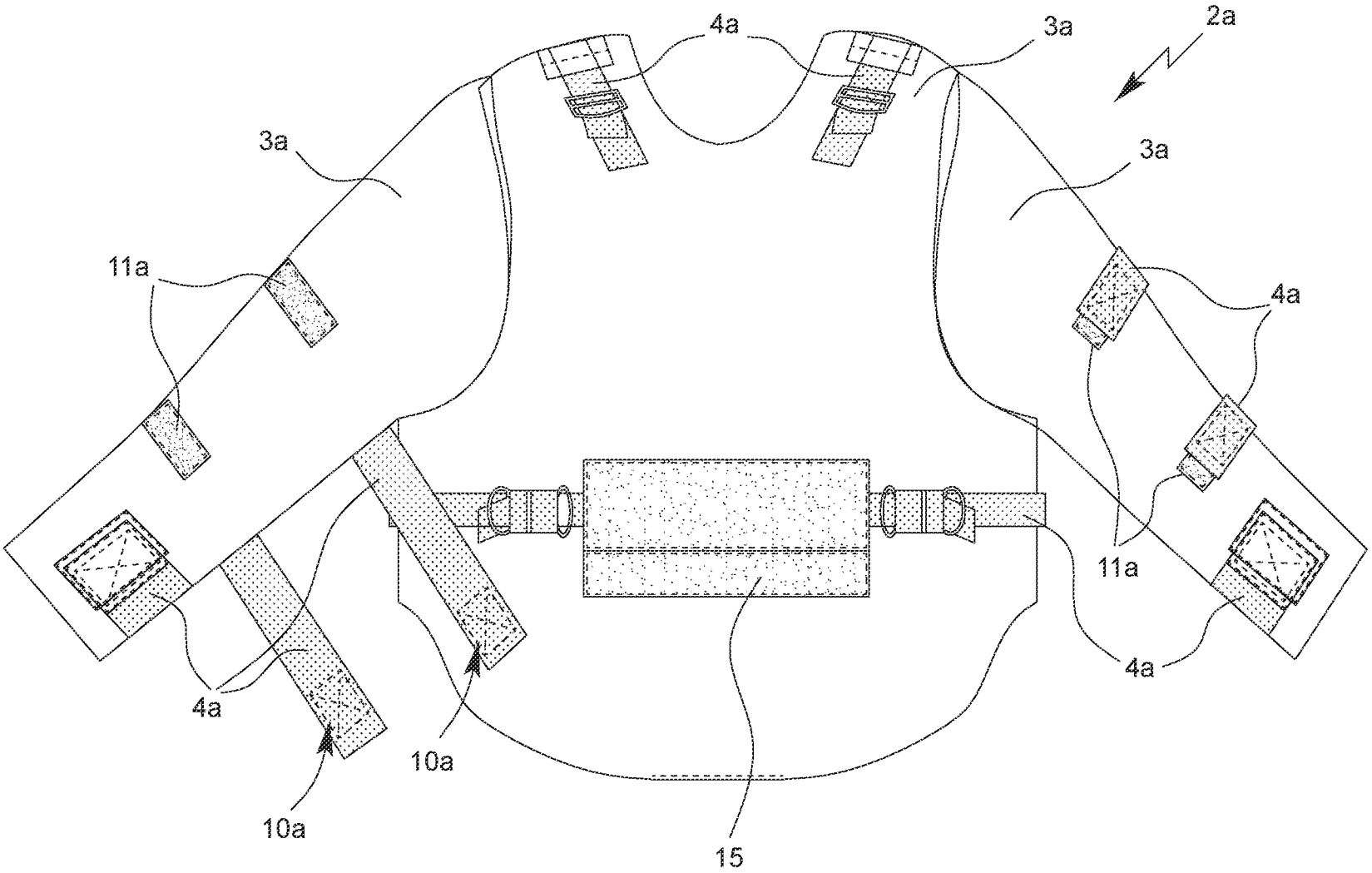
FIG. 2A provides a schematic representation showing a frontal top view of the front or outer side of an upper body protective garment of the protective clothing unit according to the invention, with the arrangement of the textile upper body protective sheet material with ballistic protective function and with the arrangement also of fixing elements and connecting means.
Figure 2B:
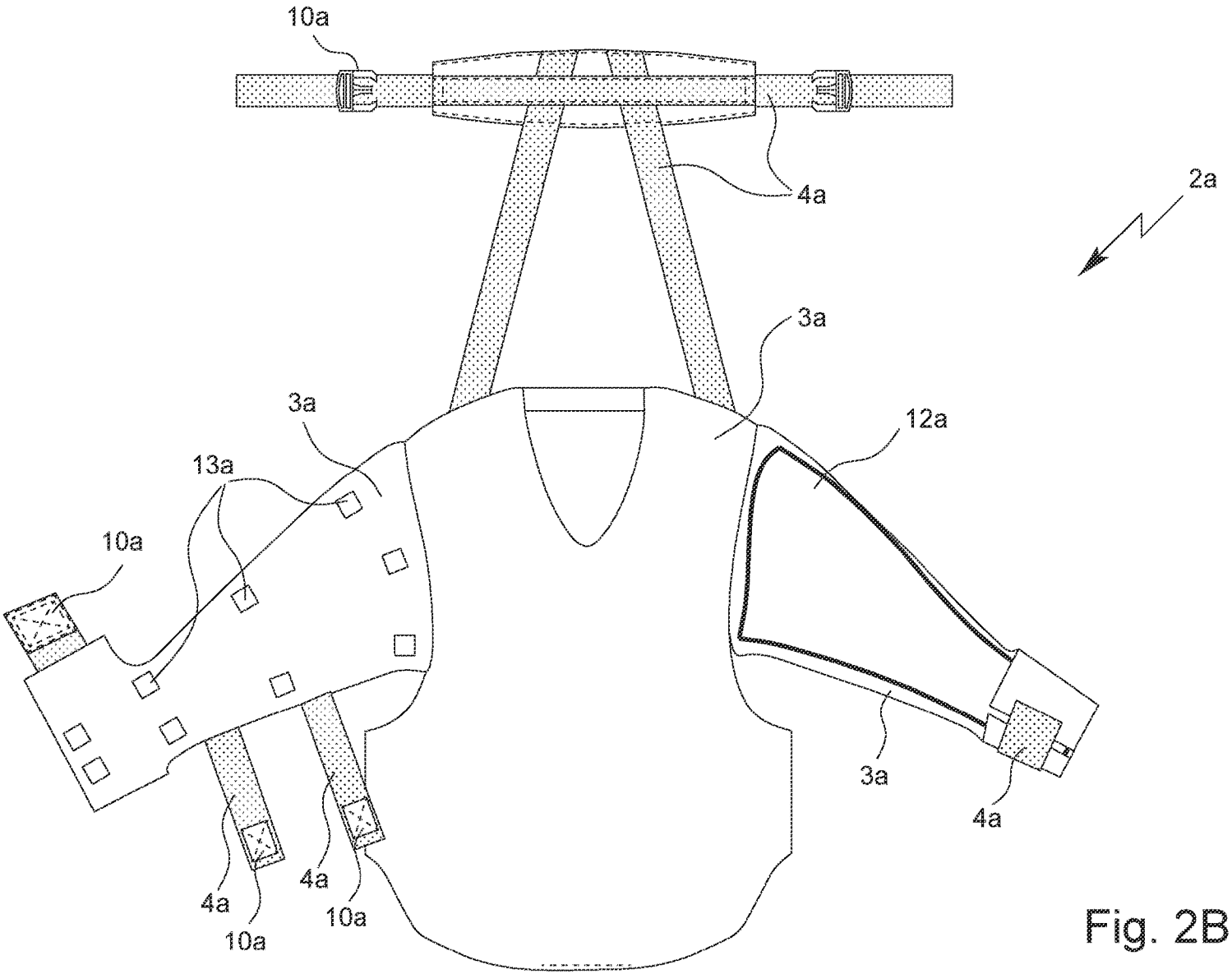
FIG. 2B provides a schematic representation corresponding to FIG. 2A with a rear side top view in an open view of the rear or inside of the upper body protective garment according to FIG. 2A with fixing elements folded upwards and extending from the shoulder regions in the form of straps with retaining belt as well as with further fixing elements and connecting means, wherein in addition the arm region on the right according to the illustration (lying on top in the illustration) is equipped on the inside with a supplementary ballistic protective element (wherein corresponding connecting or fastening means for receiving the supplementary ballistic protective element for the left arm region, which is not equipped with the ballistic protective element, are shown or visible)
Figure 2C:
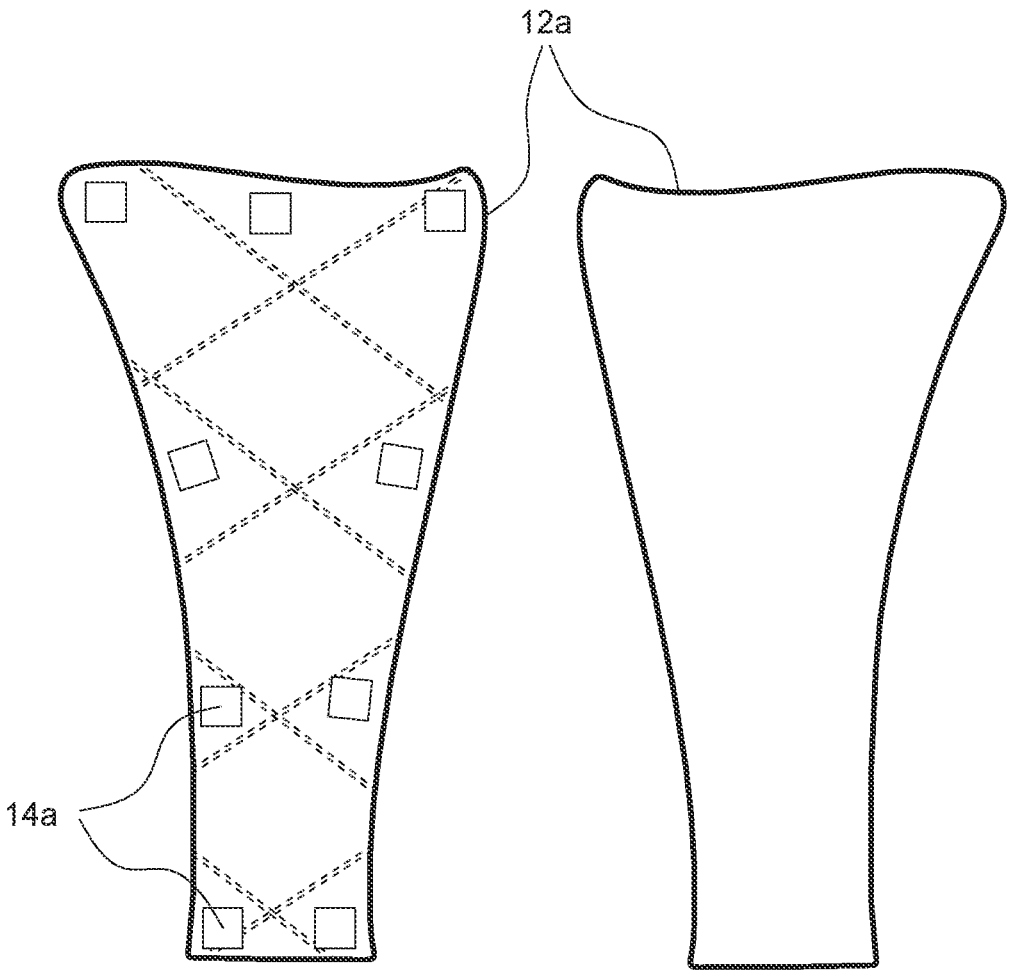
FIG. 2C provides a schematic top view of a supplementary ballistic protective element for the arm area of the upper body protective garment, namely on the side facing the upper body protective garment (i.e., facing away from the wearer) in the application state with corresponding connection or fastening means (left representation) and on the side facing away from the upper body protective garment (i.e., facing the wearer) in the application state (right representation)
Figure 3A:
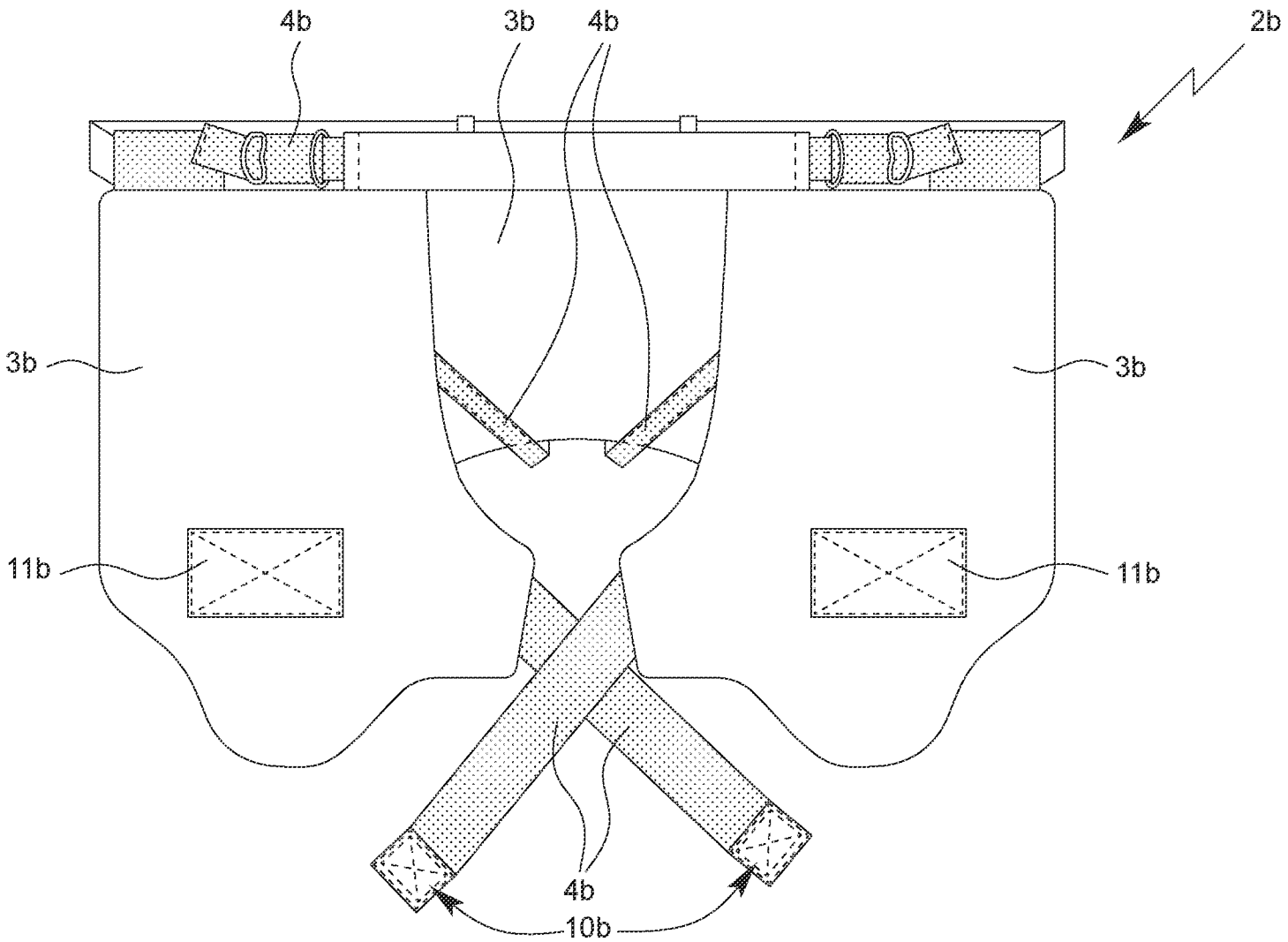
FIG. 3A provides a schematic illustration showing a frontal top view of the front or outer side of a lower body protective garment of the protective clothing unit according to the invention, with the arrangement of the textile lower body protective sheet material with ballistic protective function and with the arrangement also of fixing elements and connecting means.
Figure 3B:
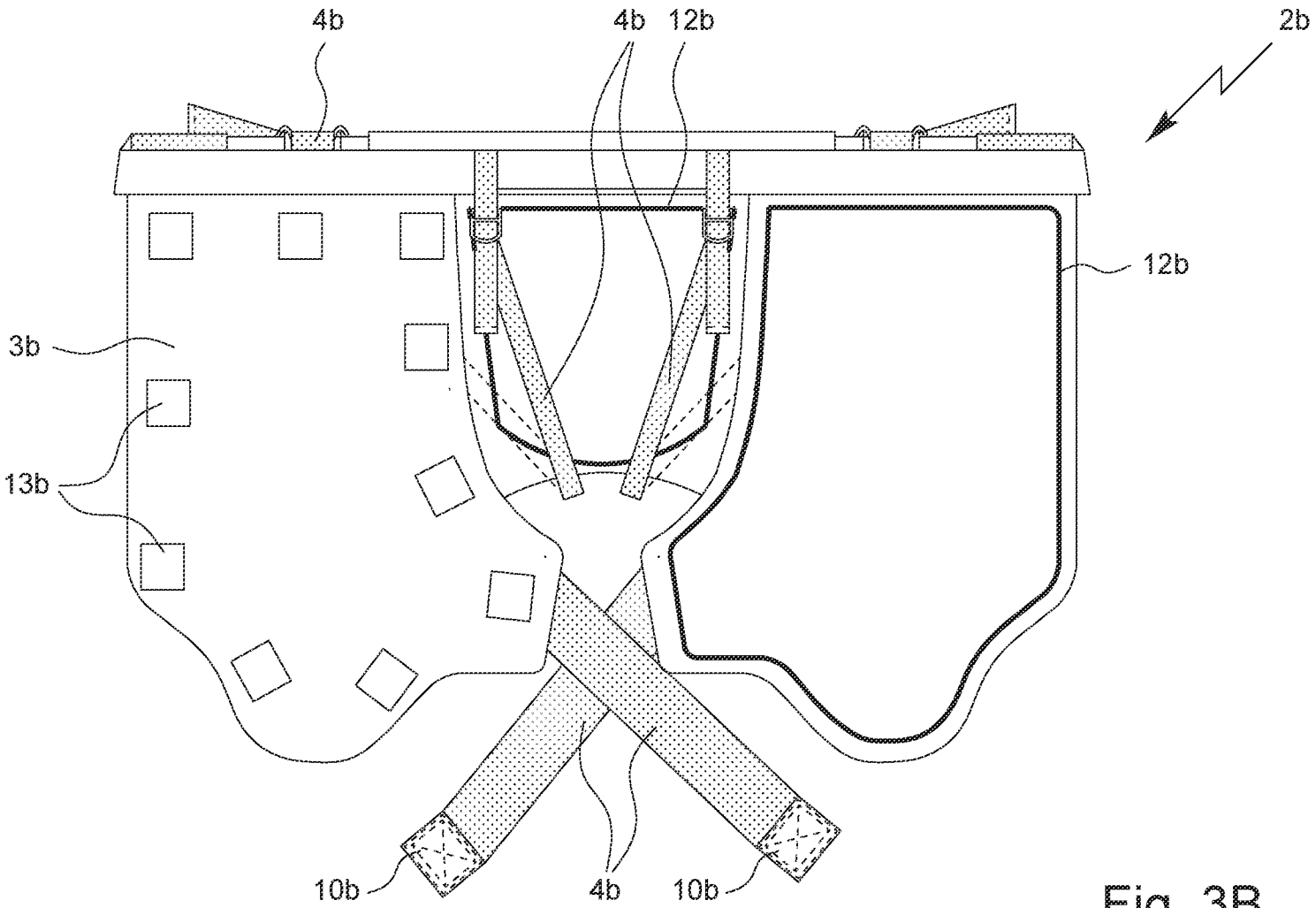
FIG. 3B provides a schematic representation corresponding to FIG. 3A with a rear side plan view of the rear or inside of the lower body protective garment according to FIG. 3A, wherein the right thigh area (lying on top in the representation) is additionally equipped with a supplementary ballistic protective element, which is fastened or connected to the lower body protective garment via corresponding fastening means (whereby the corresponding connecting means of the lower body protective garment for the area of the left thigh, which is not equipped with a ballistic protective element, are shown or visible)
Figure 3C:
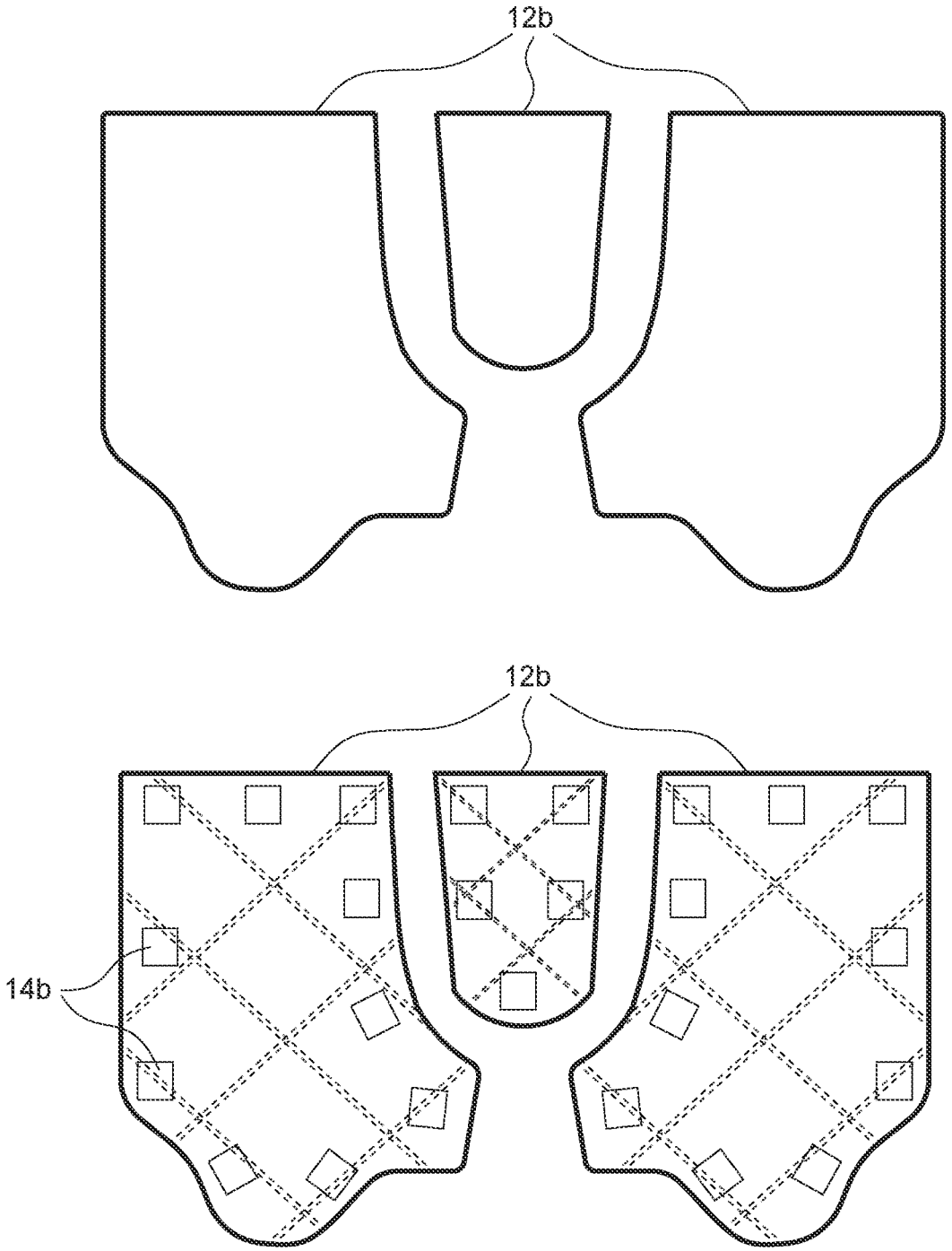
FIG. 3C provides a schematic top view of supplementary ballistic protective elements of the lower body protective garment for the hip and/or thigh area (left and right elements) and for the genital area (middle element), respectively, namely on the side facing the lower body protective garment (i.e. facing away from the wearer) in the application state (lower illustration) and on the side facing away from the lower body protective garment (i.e. facing the wearer) in the application state (upper illustration). (i.e. facing away from the wearer) in the state of use and on the side facing away from the lower body protective garment (i.e. facing the wearer) in the state of use (upper illustration)
Figure 4A:
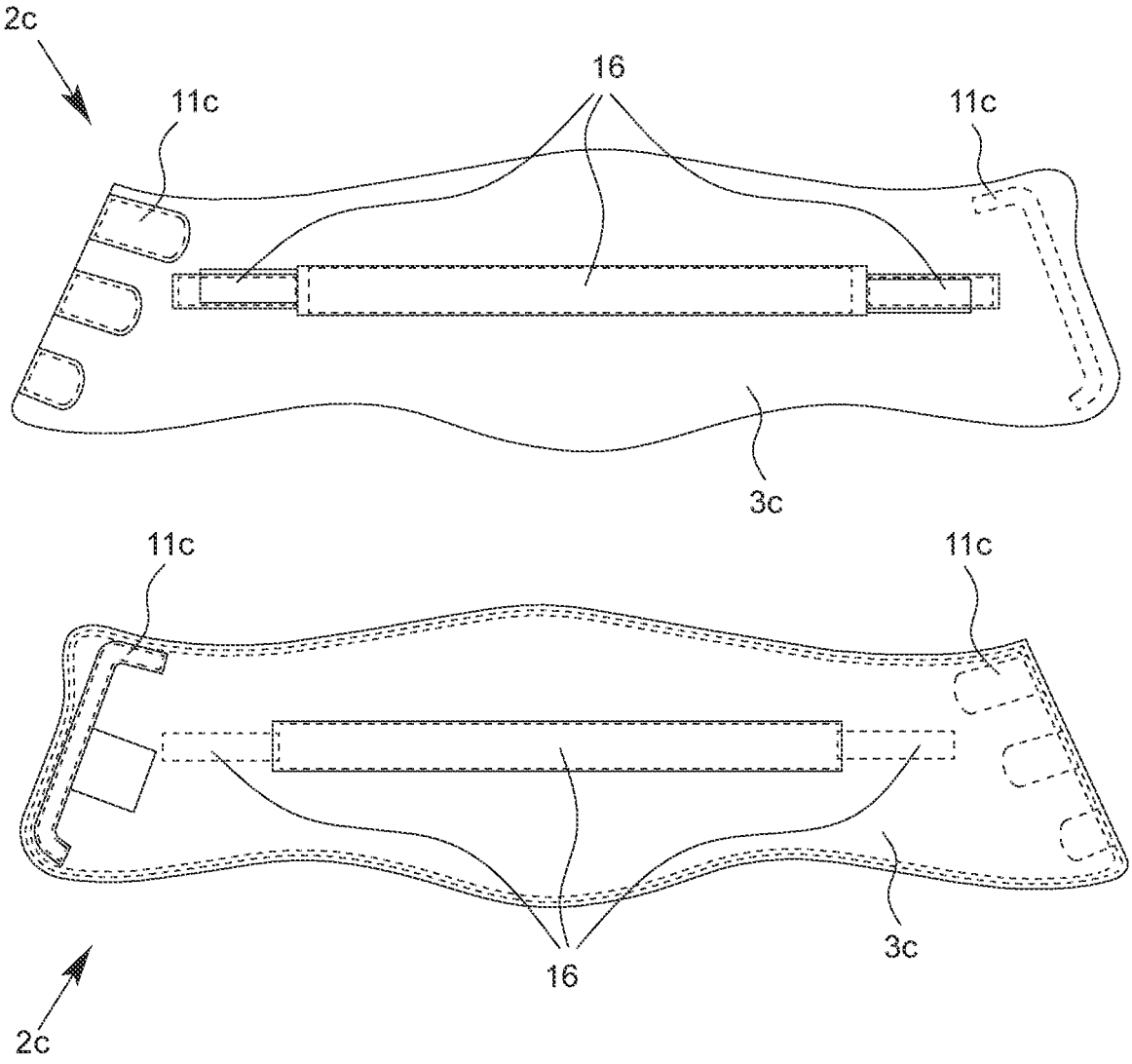
FIG. 4A provides a schematic top view of the front side or outer side (upper representation) and of the inner side (lower representation) of a neck and/or head protective garment (in the opened, flat, spread-out state) of the protective clothing unit according to the invention, according to which the neck and/or head protective garment is designed as a neck or nape protection.
Figure 4D:
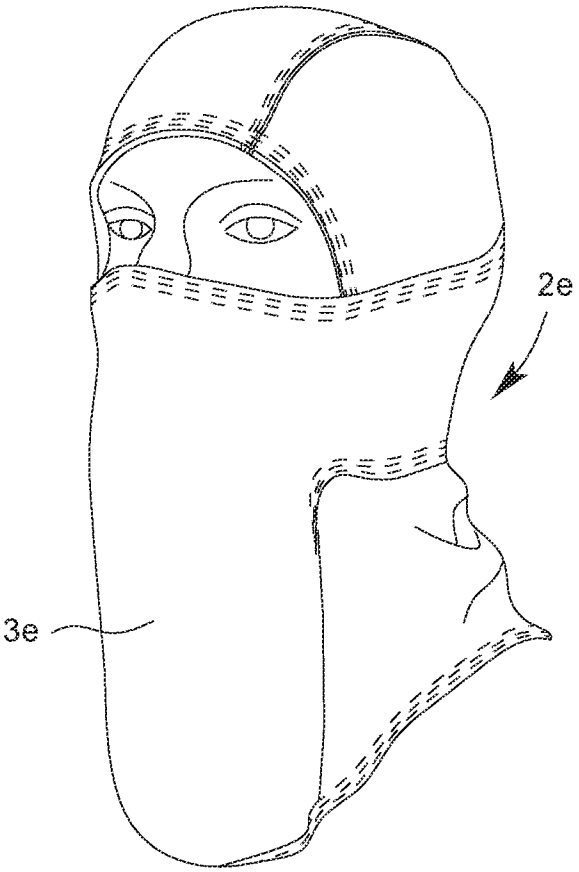
FIG. 4D provides a schematic representation of a further neck and/or head protective garment of the protective clothing unit according to the invention in the wearing or application state, wherein the neck and/or head protective garment is designed as a balaclava with simultaneous neck, face and head protection.
Figure 4C:
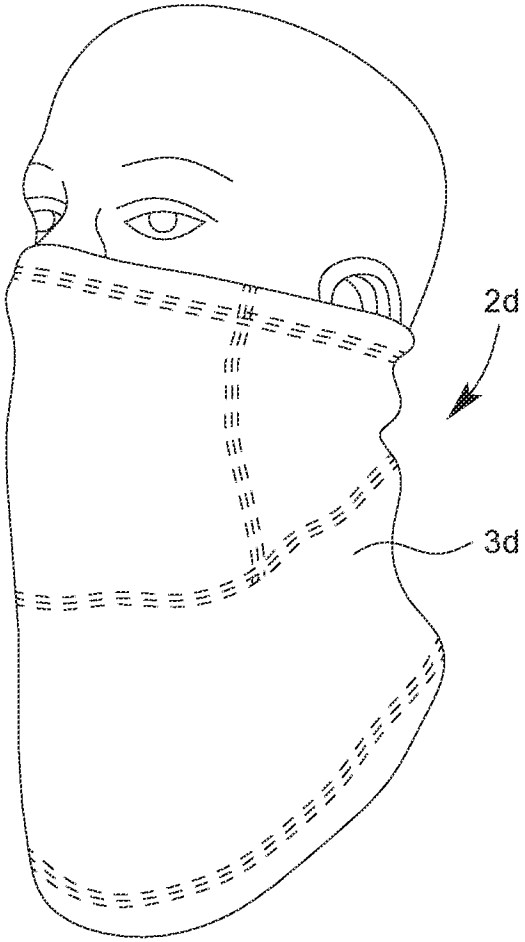
FIG. 4C provides a schematic representation of a further neck and/or head protective garment of the protective clothing unit according to the invention in the wearing or application state, wherein the neck and/or head protective garment is designed as a neck and/or face protection.
Figure 4B:
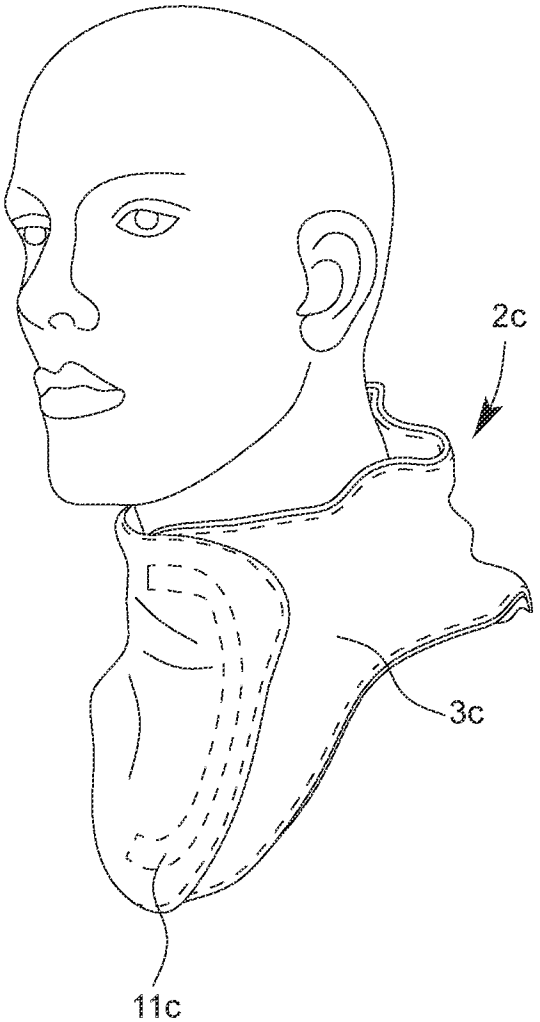
FIG. 4B provides a schematic representation of a neck and/or head protective garment of the protective clothing unit according to the invention corresponding to FIG. 4A and designed as a neck or neck protector in the wearing or application state.
Figure 5:
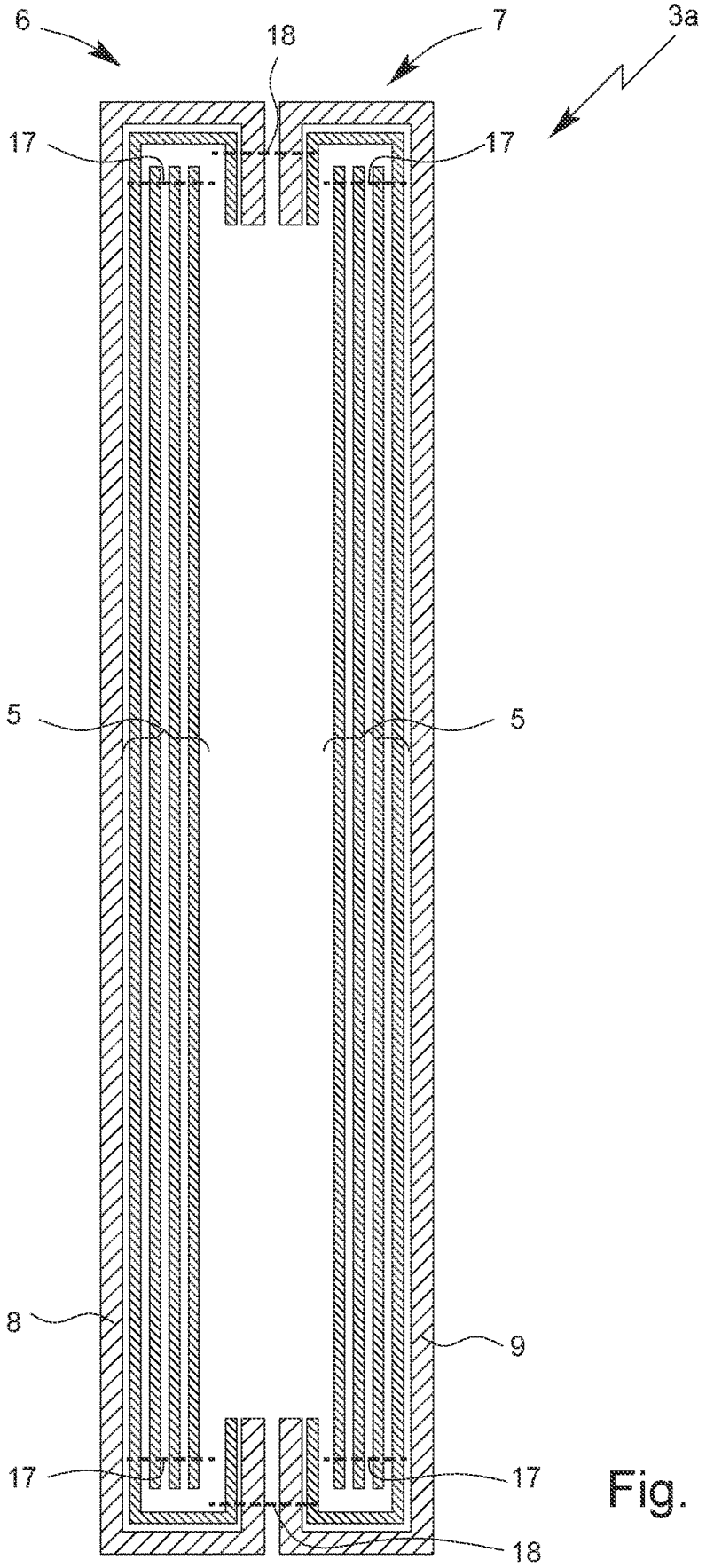
FIG. 5 provides a schematic cross-sectional view of a textile sheet material with ballistic protection function which can be used for the garments of the ballistic protective clothing unit, the textile sheet material having a plurality of and inwardly arranged layers of a ballistic protective material used for this purpose, the ballistic protective material or the layers relating thereto being divided into two ballistic protective units or packages, which in addition each have an outwardly arranged textile covering material, and the respective ballistic protective units being combined to form the textile sheet material.

In the figure representations shows:

FIG. 1A a schematic representation showing a frontal top view of the front of a protective clothing unit according to the invention with an upper body protective garment and a lower body protective garment in the state of wear or use;

FIG. 1B a schematic representation corresponding to FIG. 1A with a rear side top view of the rear side of the protective clothing unit according to the invention as shown in FIG. 1A in the wearing or application state with the rear side arrangement of fixing elements;

FIG. 2A a schematic representation showing a frontal top view of the front or outer side of an upper body protective garment of the protective clothing unit according to the invention, with the arrangement of the textile upper body protective sheet material with ballistic protective function and with the arrangement also of fixing elements and connecting means;

FIG. 2B a schematic representation corresponding to FIG. 2A with a rear side top view in an open view of the rear or inside of the upper body protective garment according to FIG. 2A with fixing elements folded upwards and extending from the shoulder regions in the form of straps with retaining belt as well as with further fixing elements and connecting means, wherein in addition the arm region on the right according to the illustration (lying on top in the illustration) is equipped on the inside with a supplementary ballistic protective element (wherein corresponding connecting or fastening means for receiving the supplementary ballistic protective element for the left arm region, which is not equipped with the ballistic protective element, are shown or visible);

FIG. 2C a schematic top view of a supplementary ballistic protective element for the arm area of the upper body protective garment, namely on the side facing the upper body protective garment (i.e., facing away from the wearer) in the application state with corresponding connection or fastening means (left representation) and on the side facing away from the upper body protective garment (i.e., facing the wearer) in the application state (right representation);

FIG. 3A a schematic illustration showing a frontal top view of the front or outer side of a lower body protective garment of the protective clothing unit according to the invention, with the arrangement of the textile lower body protective sheet material with ballistic protective function and with the arrangement also of fixing elements and connecting means;

FIG. 3B a schematic representation corresponding to FIG. 3A with a rear side plan view of the rear or inside of the lower body protective garment according to FIG. 3A, wherein the right thigh area (lying on top in the representation) is additionally equipped with a supplementary ballistic protective element, which is fastened or connected to the lower body protective garment via corresponding fastening means (whereby the corresponding connecting means of the lower body protective garment for the area of the left thigh, which is not equipped with a ballistic protective element, are shown or visible);

FIG. 3C a schematic top view of supplementary ballistic protective elements of the lower body protective garment for the hip and/or thigh area (left and right elements) and for the genital area (middle element), respectively, namely on the side facing the lower body protective garment (i.e. facing away from the wearer) in the application state (lower illustration) and on the side facing away from the lower body protective garment (i.e. facing the wearer) in the application state (upper illustration). (i.e. facing away from the wearer) in the state of use and on the side facing away from the lower body protective garment (i.e. facing the wearer) in the state of use (upper illustration);

FIG. 4A a schematic top view of the front side or outer side (upper representation) and of the inner side (lower representation) of a neck and/or head protective garment (in the opened, flat, spread-out state) of the protective clothing unit according to the invention, according to which the neck and/or head protective garment is designed as a neck or nape protection;

FIG. 4B a schematic representation of a neck and/or head protective garment of the protective clothing unit according to the invention corresponding to FIG. 4A and designed as a neck or neck protector in the wearing or application state;

FIG. 4C a schematic representation of a further neck and/or head protective garment of the protective clothing unit according to the invention in the wearing or application state, wherein the neck and/or head protective garment is designed as a neck and/or face protection;

FIG. 4D a schematic representation of a further neck and/or head protective garment of the protective clothing unit according to the invention in the wearing or application state, wherein the neck and/or head protective garment is designed as a balaclava with simultaneous neck, face and head protection;

FIG. 5 a schematic cross-sectional view of a textile sheet material with ballistic protection function which can be used for the garments of the ballistic protective clothing unit, the textile sheet material having a plurality of and inwardly arranged layers of a ballistic protective material used for this purpose, the ballistic protective material or the layers relating thereto being divided into two ballistic protective units or packages, which in addition each have an outwardly arranged textile covering material, and the respective ballistic protective units being combined to form the textile sheet material.

The figures according to FIG. 1A. FIG. 1B, FIG. 2A, FIG. 2B, FIG. 2C, FIG. 3A. FIG. 3B, FIG. 3C, FIG. 4A, FIG. 4B, FIG. 4C as well as FIG. 4D and FIG. 5 illustrate in particular the first aspect of the present invention, according to which the ballistic protective clothing unit 1, in particular with splinter, stab or cut protection, preferably with splinter protection, in particular for use as protective equipment, preferably for the military or civilian sector, in particular for retrofitting on or putting on over an outer garment, is provided wherein the protective clothing unit 1 has a plurality of, in particular at least two, preferably at least three, independent ballistic protective garments 2*a*, 2*b*, 2*c*, 2*d*, 2*e*, in particular each with splinter protection, stab protection and/or cut protection, preferably each with splinter protection, which are in particular separate from one another and/or separately present, preferably assigned to one another and/or matched to one another and/or complementary to one another, wherein the protective clothing unit 1 comprises at least two of the following ballistic protective garments 2*a*, 2*b*, 2*c*, 2*d*, 2*e:*

(A) a ballistic upper body protective garment 2*a*, in particular with splinter, stab and/or cut protection, preferably with splinter protection;

wherein the upper body protective garment 2*a* is formed for ballistic protection of an upper body portion including at least (A-i) the front (front side) torso, (A-ii) the front shoulders and (A-iii) the front arms, the upper body protective garment 2*a* comprising at least one textile sheet material 3*a* (upper body protective surface material) having ballistic protection function and covering the upper body portion;

wherein the upper body protective garment 2*a* is formed in the rear region of the torso at least regionally free of material, preferably at least substantially completely free of material; and wherein the upper body protective garment 2*a* is equipped with at least one fixing element (upper body protective fixing element) 4*a*, preferably for in particular subsequent attachment to and/or putting on (donning) of the upper body protective garment 2*a* over an outer garment, in particular jacket, in particular in the edge region of the upper body protective garment 2*a;*

(B) a ballistic lower body protective garment 2*b*, in particular with splinter, stab and/or cut protection, preferably with splinter protection;

wherein the lower body protective garment 2*b* is formed for ballistic protection of a lower body region comprising at least (B-i) the front upper legs (thighs), optionally (B-ii) the front hip and optionally (B-iii) the genital region, wherein the lower body protective garment comprises at least one textile sheet material (lower body protective surface material) 3*b* having a ballistic protection function and covering the lower body region;

wherein the lower body protective garment 2*b* is formed in the rear region of the upper legs at least regionally free of material, preferably at least substantially completely free of material; and wherein the lower body protective garment 2*b* has at least one fixing element (lower body protection fixing element) 4*b* in the rear region of the upper legs, preferably for in particular subsequently attaching to and/or putting on (donning) the lower body protective garment 2*b* over an outer garment, in particular trousers;

and (C) at least one ballistic neck and/or head protective garment 2*c*, 2*d*, 2*e*, in particular with splinter, stab and/or cut protection, preferably with splinter protection, wherein the neck and/or head protective garment 2*c*, 2*d*, 2*e* is designed for ballistic protection of a neck and/or head region, which comprises at least (C-i) the neck in particular on the front side and/or (C-ii) the head, wherein the neck and/or head protective garment 2*c*, 2*d*, 2*e* has at least one textile sheet material (neck and/or head protection surface material) 3*c*, 3*d*, 3*e* with ballistic protection function, which covers the neck and/or head region.

For further preferred embodiments of the protective clothing unit 1 according to the invention, reference can furthermore also be made to the corresponding sub- and auxiliary claims.

As already indicated before, the protective clothing unit 1 according to the invention has a modularity, according to which corresponding items of clothing can be individually combined with one another, in particular against the background of the respective conditions of use or application, to form the protective clothing unit, wherein, moreover, the respective protective garments 2*a*, 2*b*, 2*c* can be individually designed or tailored for the protection of specific body regions, both with regard to the specific body regions to be protected as such and also with regard to the respective protective strength provided. Through this, a high variability and adaptability of the protective clothing unit 1 according to the invention is provided overall, so that it can be adapted situationally to the respective conditions, while at the same time a high wearing comfort or a high freedom of movement is ensured. Consequently, the protective clothing unit 1 according to the invention combines both corresponding ballistic protective clothing properties and a more advanced wearing comfort.

In light of the above, one embodiment according to the invention can be seen, for example, in the fact that, as illustrated in FIG. 1A and FIG. 1B, the protective clothing unit 1 comprises or consists of the ballistic upper body protective garment 2*a* and the lower body protective garment 2*b*. Hereby, in particular, a corresponding protection for the area of the torso as well as the lower extremities, in particular the thighs, can be provided.

According to a further embodiment according to the invention, the protective clothing unit 1 can comprise or consist of the ballistic upper body protective garment 2*a* and the neck and/or head protective garment 2*c*, 2*d*, 2*e* (cf. also FIG. 4A to FIG. 4D of the respective neck and/or head protective garments). In this way, combined protection can be provided, in particular of the front upper area of the torso, for example including the arms, as well as of the neck area.

Furthermore, it may also be provided in the context of the present invention that the protective clothing unit 1 according to the invention comprises or consists of the ballistic upper body protective garment 2*a* and the lower body protective garment 2*b* and the neck and/or head protective garment 2*c*, 2*d*, 2*e*. Hereby, a particularly comprehensive ballistic protection can be provided for the corresponding correlating body areas.

According to the invention, it can behave in particular in such a way that (A) the textile sheet material (upper body protective sheet material) 3*a* covers the upper body area at least partially and/or in areas, in particular at least 30%, preferably at least 50%, preferably at least 70%, particularly preferably at least 90%, very particularly preferably at least 95%, relative to the area of the upper body area.

According to a further embodiment according to the invention, it may also be provided that the textile sheet material (upper body protective sheet material) 3*a* covers the upper body region at least substantially completely and/or at least substantially without interruption and/or at least substantially continuously and/or as an at least substantially continuous surface. This increases the protective function by reducing the formation of any weak points.

Furthermore, with respect to (B), the textile sheet material (lower body protective sheet material) 3*b* may behave in such a way that it covers the lower body region at least partially or regionally, in particular at least 30%, preferably at least 50%, preferably at least 70%, particularly preferably at least 90%, very particularly preferably at least 95%, relative to the area of the upper body region. In particular, the textile sheet material (lower body protective sheet material) 3*b* may cover the lower body area at least substantially completely. Again, an at least substantially uninterrupted and/or at least substantially continuous and/or at least substantially continuous covering and/or a covering as an at least substantially continuous surface may be realized.

As regards furthermore (C) the textile sheet material (neck and/or head protective surface material) 3*c*, 3*d*, 3*e*, this can cover the neck and/or head area at least partially or area-wise, in particular at least 30%, preferably at least 50%, preferably at least 70%, particularly preferably at least 90%, very particularly preferably at least 95%, in relation to the area of the upper body area. In this respect, it may also be provided according to the invention that textile sheet material (neck and/or head protective surface material) 3*c*, 3*d*, 3*e* covers the neck or head area at least substantially completely. Here, too, an at least substantially uninterrupted and/or at least substantially continuous and/or at least substantially continuous covering and/or a covering as an at least substantially continuous surface can be realized.

The above-mentioned degrees of coverage, in particular the at least substantially complete coverage of the corresponding body regions, as may be provided in accordance with the invention, provide particularly efficient and correspondingly large-area splinter, puncture or cut protection, preferably splinter protection or corresponding ballistic protection. As previously indicated, the body regions in question are in particular those which, in the state of use or application of the protective clothing unit according to the invention, face the source of danger or a possible source of explosion. In particular, the respective body areas comprise the areas or sections of the body of a relevant wearer of the protective clothing unit according to the invention as indicated above or below.

As indicated in detail below, the respective garments 2*a*, 2*b*, 2*c*, 2*d*, 2*e* of the protective clothing unit 1 according to the invention can be designed or tailored with regard to the covering of special body areas or sections, so that a corresponding area- or section-wise protective function is provided in this respect. In the present case, it is particularly the case that the body regions or sections mentioned below for the respective garments 2*a*, 2*b*, 2*c*, 2*d*, 2*e* are covered by the respective textile sheet material with a ballistic protective function within the meaning of the present invention, in particular also in accordance with the preceding embodiments.

In particular, with regard to (A) the upper body protective garment 2*a* can behave in such a way that the upper body area additionally [i.e., in addition to (A-i) the front (front-side) torso, (A-ii) the front-side shoulders and (A-iii) the front-side or side arms] also includes (A-iv) the front-side hip and/or (A-v) the genital area. Hereby, the protective function can also be extended to the aforementioned areas in a complementary manner.

Moreover, according to the invention, it may also be provided that (A) the upper body region further comprises (A-vi) the lateral torso and/or (A-vii) the upper and/or rear shoulders and/or the (A-viii) the lateral hip. Moreover, according to the invention, it can also be provided that (A) the upper torso region further comprises (A-ix) the lower inside arm and/or wrist region. In this way, the region of the lower arm adjoining the wrist or the wrist region as such can be fully covered by the corresponding textile sheet material 3*a*.

According to a preferred embodiment according to the invention, it may be provided in particular that (A) the upper body region (A-i) comprises the front (frontal) torso, (A-ii) the front shoulders, (A-iii) the front and/or side arms, (A-iv) optionally the front side hip, (A-vi) the side torso, (A-vii) the top side shoulders, (A-viii) optionally the side hip, and (A-ix) the lower inside arm and/or wrist area.

In particular, due to the presence of corresponding arm areas and/or material-free areas in the back area, it also behaves in particular in the present case in such a way that the upper body protective garment 2*a* is not in the form of a vest or is not vest-like (cf. e.g., FIG. 2A).

In addition, for (B) the lower body protective garment 2*b*, with respect to the coverage of the lower body area by the textile sheet material 3*b*, the following should also be mentioned:

In particular, (B) the lower body region may further include [i.e., in addition to (B-i) the front upper legs (thighs)] (B-ii) the front hip and/or (B-iii) the genital region and/or (B-vi) the front knee region and/or (B-v) the front lower torso portion (abdomen) and/or (B-vi) the front lower legs (lower thighs). For example, (B) the lower body portion may include (B-i) the front upper legs (upper thighs), (B-ii) the front hips, and (B-iii) the genital portion.

Further, (B) the lower body portion may further include (B-vii) the lateral upper legs (thighs) and/or (B-viii) the lateral hip and/or (B-ix) the lateral knee portion and/or (B-x) the lateral lower torso portion (abdomen) and/or (B-xi) the lateral lower legs (lower legs).

According to an embodiment according to the invention, it may be equally provided that (B) the lower body region comprises (B-i) the front upper legs (thighs), (B-ii) the front hip, (B-iii) the genital region, optionally (B-vi) the front knee region, (B-vii) the side upper legs (thighs) and (B-viii) the side hip.

According to the invention, it is in particular the case that the lower body protective garment 2*b* is not in the form of an apron or not in the form of an apron, in particular as a result of the presence of two, so to speak, separate leg sections, namely for the right leg and for the left leg respectively (cf. e.g., FIG. 3A).

Finally, for (C) the ballistic neck or head protective garment 2*c*, 2*d*, 2*e*, with respect to the neck or head area to be covered by the textile sheet material 3*c*, 3*d*, 3*e*, if any, it may also be as follows.

In particular, (C) the neck and/or head region may further comprise (C-iii) the lateral neck and/or (C-iv) the dorsal neck (nape) and/or (C-v) the lower facial region and/or (C-vi) the cheek region and/or (C-vii) the mouth and/or (C-viii) the nose and/or (C-ix) the forehead and/or (C-x) the top and/or back of the head.

In particular, (C) can comprise the neck and/or head region (C-i) the neck, in particular the front neck, (C-iii) the side neck, and (C-iv) the back neck (nape).

In the following, further and embodiments according to the invention are discussed with regard to the further embodiment of the protective clothing unit 1 according to the invention:

Thus, according to the invention, as previously indicated, it may in particular be the case that the protective clothing unit 1 comprises or consists of the ballistic upper body protective garment 2*a* ad the lower body protective garment 2*b*. For this aforementioned embodiment of the protective clothing unit 1 according to the invention, it may thereby be provided in particular that (A) the upper body area (A-i) comprises the frontal (frontal) torso, (A-ii) the frontal shoulders, (A-iii) the front-side and/or side arms, (A-iv) optionally the front-side hip, (A-vi) the side torso, (A-vii) the top-side shoulders, (A-viii) optionally the side hip, and (A-ix) the lower inside arm and/or wrist area; and that (B) the lower body region comprises (B-i) the front upper legs (thighs), (B-ii) the front hip, (B-iii) the genital region, (B-vi) the front knee region, (B-vii) the side upper legs (thighs), (B-viii) the side hip and (B-ix) optionally the side knee region.

Furthermore, according to another preferred embodiment according to the invention, it may also be provided that the protective clothing unit 1 comprises or consists of the ballistic upper body protective garment 2*a* and the neck and/or head protective garment 2*c*, 2*d*, 2*e*, as previously indicated. In particular in this context, it may be provided according to the invention that (A) the upper body portion (A-i) comprises the front (frontal) torso, (A-ii) the frontal shoulders, (A-iii) the frontal and/or lateral arms, (A-iv) optionally the front side hip, (A-vi) the side torso, (A-vii) the top side shoulders, (A-vii) optionally the side hip, and (A-ix) the lower inside arm and/or wrist area; and that (C) the neck and/or head region comprises (C-i) the neck, in particular the anterior neck, (C-iii) the lateral neck and (C-iv) the posterior neck (nape).

According to yet another embodiment, the protective clothing unit 1 according to the present invention may also be configured such that it comprises or consists of the ballistic upper body protective garment 2*a* and the lower body protective garment 2*b* and the neck and/or head protective garment 2*c*, 2*d*, 2*e*, as previously indicated. In particular, for this embodiment of the present invention, it may be provided thereby that (A) the upper body portion (A-i) comprises the front (frontal) torso, (A-ii) the front shoulders, (A-iii) the front and/or side arms, (A-iv) optionally the front side hip, (A-vi) the side torso, (A-vii) the top side shoulders, (A-viii) optionally the side hip, and (A-ix) the lower inside arm and/or wrist area; and that (B) the lower body region comprises (B-i) the anterior upper legs (thighs), (B-ii) the anterior hip, (B-iii) the genital region, (B-vi) the anterior knee region, (B-vii) the lateral upper legs (thighs), (B-viii) the lateral hip, and (B-ix) optionally the lateral knee region; and in that (C) the neck and/or head region comprises (C-i) the neck, in particular the front neck, (C-iii) the lateral neck and (C-iv) the rear neck (nape).

According to the invention, the outer clothing on which the protective clothing unit 1 according to the invention is put on or worn is, in particular, NBC protective equipment (synonymously also referred to as CBRN protective equipment). According to the invention, this may in particular be NBC protective clothing or the like, preferably NBC protective outer clothing. In particular, jackets, pants, overalls or the like can be used in this respect. As indicated before, it behaves in the context of the present invention in particular in such a way that a situationally and/or individually adaptable combined protection can be provided both against ballistic impact and against appropriate poison and/or warfare agents. In this context, it can also be provided in accordance with the invention that the outer garment is not a component and/or object of the protective clothing unit 1.

Furthermore, the protective clothing unit 1 according to the invention can also be characterized by the following features, and also in specific combination with the features or technical measures listed above:

With further reference to the present invention, the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, may be individually and/or at least substantially independently of each other attachable and/or put on over the outer garment, in particular at least substantially independently of each other put on over the outer garment.

In particular, the protective garments 2*a*, 2*b*, 2*c*, 2*d*, 2*e*, especially the upper body protective garment 2*a* and/or the lower body protective garment 2*b* and/or the neck and/or head protective garment 2*c*, 2*d*, 2*e*, may be removable from the outer garment individually and/or at least substantially independently of each other and/or removable from the outer garment at least substantially independently of each other, especially at least substantially independently of each other.

According to the invention, it is possible in particular for the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, to be present unconnected to one another and/or not firmly connected to one another.

In addition, it may be provided within the scope of the present invention that the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, form complementary and/or coordinated and/or complementary ballistic protection areas, in particular for ballistic protection of the upper body area and/or the lower body area and/or the neck and/or head area (cf. e.g. FIG. 1A and FIG. 1B).

Furthermore, according to the invention, it is also possible for the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, in particular independently of one another, to be unconnected and/or not firmly connected to the outer garment and/or to be loose with respect to the outer garment.

Furthermore, it can be provided according to the invention that the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, in particular independently of one another, lie on and/or against the outer garment, in particular separately and/or separately and/or unconnectedly and/or loosely.

The aforementioned measures according to the invention further ensure the modularity underlying the protective clothing unit 1 according to the invention with a high degree of individual or situational adaptability of the protective properties provided, as well as excellent manageability.

According to the invention, it can also be provided that the upper body protective garment 2*a* and/or the lower body protective garment 2*b* are each held in position on the outer garment, in particular independently of one another, by means of the fixing elements 4*a*, 4*b*. In particular, it is the case that the fixing elements 4*a*, 4*b*, in particular independently of one another, are in each case unconnected and/or not firmly connected to the outer clothing and/or are loose with respect to the outer clothing.

In addition to facilitating donning and doffing, this also ensures a slip-proof and stable fit of the protective clothing, even when exposed to high forces (e.g., in the event of an accidental detonation or the like with the associated shock wave), while at the same time ensuring excellent manageability.

In the following, the conception of the use of at least one fixing element (hereinafter also referred to only as fixing elements as such) in accordance with the patent in suit will be discussed in more detail, in particular for ensuring a secure positioning of the protective clothing unit:

As illustrated, for example, in FIG. 2A and FIG. 2B, it can be provided in accordance with the invention that the fixing elements 4*a*, 4*b* of the upper body protective garment 2*a* and/or of the lower body protective garment 2*b*, independently of one another, are each in the form of a band, a belt and/or a strap.

In this respect, it may be provided in particular that the fixing elements 4*a*, 4*b* of the upper body protective garment 2*a* and/or of the lower body protective garment 2*b*, independently of each other, are each in the form of straps, belts and/or straps.

According to the invention, it can be equally provided that the fixing elements 4*a*, 4*b* of the upper body protective garment 2*a* and/or of the lower body protective garment 2*b*, independently of each other, are designed to be elastically and/or reversibly stretchable.

According to the invention, it is equally possible for the fixing elements 4*a*, 4*b* to be width-adjustable and/or to have a width adjustment. This can be done, for example, by using special connecting means, such as buckles or the like.

In particular, the fixing elements 4*a*, 4*b*, can be formed independently of each other, for example, in particular in the form of textile webbing, rubber bands or the like.

The special design of the fixing elements, as mentioned above, further improves the positioning and securing of the protective clothing unit in the use or wearing state, since the underlying fixing elements 4*a*, 4*b* can be optimized, for example, to suit the specific arrangement or run. Due to the elastic properties, if any, additional tensile stress can also be provided, which further improves the slip-proof fit of the protective clothing unit when worn. The width adjustment provided, if any, also makes it possible to achieve optimum adaptation and securing in the state of wear or use.

As equally shown in particular in FIG. 2A and FIG. 2B, the fixing elements 4*a*, 4*b* of the upper body protective garment 2*a* and/or of the lower body protective garment 2*b*, independently of each other, can each be attached or fastened at least on the edge side and/or at least in the edge region of the textile sheet material 3*a*, 3*b*.

In this context, it may be provided in particular that the fixing elements 4*a*, 4*b* have an (end) portion (fixed end) attached and/or fastened to the textile sheet material 3*a*, 3*b*.

In this context, it is possible in principle for the fixing elements 4*a*, 4*b* to be incorporated or fixed on the edge side, in particular on the edge side, for example during the manufacturing process of the textile sheet material 3*a*, 3*b*, which is also associated not least with advantages in terms of production technology.

In general, the fixing elements 4*a*, 4*b* of the upper body protective garment 2*a* and of the lower body protective garment 2*b*, respectively, independently of each other, each starting from the textile sheet material 3*a*, 3*b*, in particular starting from the edge region of the textile sheet material 3*a*, 3*b*, can be at least substantially freely movable or have a free (end) portion (free end) and/or protruding from the textile sheet material 3*a*, 3*b*. In particular, this is the (end) section of the respective fixing elements 4*a*, 4*b* that is not directly attached to the textile sheet material 3*a*, 3*b*. In this regard, reference can equally be made to FIG. 2A and FIG. 3A, for example.

According to the present invention, the fixing elements 4*a*, 4*b* of the upper body protective garment 2*a* and/or of the lower body protective garment 2*b* can, independently of each other, each starting from the textile sheet material 3*a*, 3*b*, 3*c*, in particular starting from the edge region of the textile sheet material 3*a*, 3*b* and/or in the region of the (end) section (free end) not attached and/or fastened to the textile sheet material 3*a*, 3*b*, on the one hand, to further fixing elements and/or correlating and/or complementary thereto and/or, on the other hand, to further regions and/or sections of the textile sheet material 3*a*, 3*b*, preferably detachably and/or reversibly connectable. In this respect, the connection can be made via connecting means of the fixing elements 4*a*, 4*b* to be connected, which are described below. In this way, the protective clothing unit or the underlying garment can be held in position in the wearing or application state. In this connection, for example, FIG. 1A as well as FIG. 2A (for example, right arm there) show the state according to which the fixing elements 4*a*, 4*b* are present with corresponding connection or, as it were, in the closed state. In other words, for the wearing or application state, it behaves in particular in such a way that the respective free ends of the fixing elements 4*a*, 4*b* are brought into connection with the areas or sections of other fixing elements provided in this respect, on the one hand, or of the textile sheet material 3*a*, 3*b*, on the other hand, as shown, for example, in FIG. 1A and FIG. 2A.

As shown in particular in FIG. 2A and FIG. 2B, the fixing elements 4*a*, 4*b* of the upper body protective garment 2*a* and/or the lower body protective garment 2*b*, independently of each other, may each have at least one connecting means (connecting means of the fixing elements) 10*a*, 10*b* (hereinafter also referred to only as connecting means as such).

In this respect, the connecting means 10*a*, 10*b* can serve in particular for preferably releasable and/or reversible connection to further regions, in particular edge regions, of the textile sheet material 3*a*, 3*b*, preferably in each case via at least one connecting means (connecting means of the textile sheet material) 11*a*, 11*b*, in particular as defined below.

In addition, the fixing elements 10*a*, 10*b* can serve in particular for preferably releasable or reversible connection to further fixing elements 4*a*, 4*b*, preferably via further connecting means 10*a*, 10*b* of the fixing elements 4*a*, 4*b* to be connected.

In addition, the connecting means 10*a*, 10*b* can, independently of each other, be attached or fastened in the area of the free (end) section of the fixing elements 4*a*, 4*b* and/or projecting from the textile sheet material 3*a*, 3*b* (cf. e.g., FIG. 2B as well as FIG. 3B). In this respect, the connecting means 10*a*, 10*b* can preferably be attached or positioned, as it were, in the area of the free end of the fixing elements 4*a*, 4*b* (e.g., fixedly attached in the case of hook or fluff elements or, however, displaceable in the case of buckle elements or the like).

In a non-limiting manner, the connecting means 10*a*, 10*b*, independently of each other, can be in the form of closing and/or buckle elements and/or Velcro elements (hook and/or loop elements).

For example, corresponding elements based on quick-release fasteners or adjustment buckles or the like can also be used for the connecting means 10*a*, 10*b*.

Furthermore, according to the invention, it may be provided that, as shown for example in FIG. 2A and FIG. 3A, the textile sheet material 3*a*, 3*b* of the upper body protective garment 2*a* and/or of the lower body protective garment 2*b* comprises, independently of each other, connecting means (connecting means of the textile sheet material) 11*a*, 11*b*.

In this context, the connecting means 11*a*, 11*b* for preferably releasable and/or reversible connection and/or reception of the fixing elements 4*a*, 4*b*, can preferably be formed or arranged in the region of the free (end) section of the fixing elements 4*a*, 4*b* and/or in the region of the (end) section of the fixing elements 4*a*, 4*b* projecting from the textile sheet material 3*a*, 3*b*, preferably via the connecting means 10*a*, 10*b* of the fixing elements 4*a*, 4*b* (cf. e.g. FIG. 2A and FIG. 3B).

In general, the connecting means 11*a*, 11*b*, independently of one another, can each be attached and/or fastened at least on the edge side and/or at least in the edge region of the textile sheet material 3*a*, 3*b*, in particular at such regions which correlate with or are complementary to the (end) section (fixed end) of the fixing elements 4*a*, 4*b* attached and/or fastened to the textile sheet material 3*a*, 3*b*.

In this context, the terms "correlate" or "complementary" are to be understood in particular in such a way that the corresponding positioning of the connecting means 11*a*, 11*b* on the textile sheet material 3*a*, 3*b*, respectively the fastening of the fixing elements 4*a*, 4*b* to the textile sheet material 3*a*, 3*b* is realized against the background of the intended concrete connection, for example in order to connect or span certain areas of the textile sheet material 3*a*, 3*b* from behind, as it were (which also applies in a corresponding manner to the connecting means 10*a*, 10*b* of the fixing elements 4*a*, 4*b*). For example, the connecting means 11*a*, 11*b* can be arranged in particular in an (edge) area of the textile sheet material 3*a*, 3*b* which corresponds to the in particular edge area of the textile sheet material 3*a*, 3*b* to which the fixing elements 4*a*, 4*b* are attached, as illustrated for example in FIG. 2A for the left sleeve or arm area. In the connected state, a connection can then be realized with a course of the fixing elements over the rear side, so to speak enclosing the body area to be protected in this area, which is conducive to a secure fit of the underlying garment (cf. e.g., FIG. 1A and FIG. 1B).

In general, it can be the same for the connecting means 11*a*, 11*b* to be, independently of each other, in the form of closing and/or buckle elements and/or Velcro elements (hook and/or flap elements). In this respect, the connecting means 11*a*, 11*b*, independently of each other, can also have corresponding elements based on quick-release means or adjustment buckles.

In particular, the mutually associated connecting means 10*a*, 10*b*, 11*a*, 11*b* of the fixing elements 4*a*, 4*b* on the one hand and of the textile sheet material 3*a*, 3*b* on the other hand can be connected to one another in a preferably releasable or reversible manner and/or be compatible with one another. For example, it can be provided that a connecting means 10*a*, 10*b* of a fixing element 4*a*, 4*b* is formed as a hook element, while a corresponding (i.e., compatible) connecting means 11*a*, 11*b* of the textile sheet material 3*a*, 3*b* is formed as a fluff element. On this basis, a hook-and-loop fastener can thus be provided or be present in a corresponding manner.

In general, it can be provided according to the invention that the fixing elements 4*a*, 4*b* of the upper body protective garment 2*a* and/or of the lower body protective garment 2*b*, independently of one another, in the connected state (i.e., in the closed state) connect at least two different areas, in particular at least two different edge areas, of the textile sheet material 3*a*, 3*b*, preferably releasably and/or reversibly.

In particular, the fixing elements 4*a*, 4*b* of the upper body protective garment 2*a* and/or of the lower body protective garment 2*b*, independently of one another, can span the back of the upper body region and/or the lower body region in the connected state (cf. e.g., FIG. 1A and FIG. 1B). Similarly, the fixing elements 4*a*, 4*b* of the upper body protective garment 2*a* and/or the lower body protective garment 2*b*, independently of each other, can be arranged to span the back of the upper body region and/or the lower body region in the connected state (cf. e.g., FIG. 1A and FIG. 1B). This ensures a correspondingly secure and non-slip fit of the garments underlying the protective clothing unit 1 according to the invention in the wearing or application state.

Similarly, the fixing elements 4*a*, 4*b* of the upper body protective garment 2*a* and/or of the lower body protective garment 2*b* can, independently of one another, in the connected state, in conjunction and/or together with the textile sheet material 3*a*, 3*b* at least partially surround and/or at least partially encompass and/or be arranged circumferentially with respect to the section and/or region of the upper body region and/or of the lower body region to be fixed. In this regard, reference can equally be made, for example, to FIG. 1A and FIG. 1B.

As shown in particular in FIG. 1B, according to the invention, it behaves in particular in such a way that the fixing elements 4*a* of the upper body protective garment 2*a*, independently of one another, are arranged in the connected state extending in and/or over the rear upper body region.

Similarly, according to the invention, it behaves in particular in such a way that the fixing elements 4*b* of the lower body protective garment 2*b* are arranged, independently of each other, extending in the connected state in and/or over the rear lower body region.

Moreover, according to a particularly preferred embodiment, it also behaves in accordance with the invention in such a way that, in addition to the above explanations and by way of further illustration, the fixing elements 4*a*, 4*b* and/or the connecting means 10*a*, 10*b* and/or the connecting means 11*a*, 11*b*, in particular independently of one another, are each unconnected and/or not firmly connected to the outer clothing and/or are present loosely with respect to the outer clothing (in particular in such a way that the protective clothing unit according to the invention is not firmly connected to the outer clothing as a whole, as previously indicated). This leads to the previously described easy donning and doffing of the protective clothing unit according to the invention as a whole.

According to one embodiment of the present invention, the upper body protective garment 2*a* may comprise a carrier/tie-down strap unit formed by the fixing elements 4*a* and/or comprising the fixing elements 4*a*. In this regard, reference may be made in particular to FIG. 1B (carrier/tie-down belt unit in the wearing state) and FIG. 2B (carrier/tie-down belt unit in the unfolded state). The special use of a carrier/strap unit enables a particularly secure fit or fixed positioning of the upper body protective garment in the wearing or application state, and this with simultaneous ease of handling, in particular with regard to donning and doffing.

In this regard, the carrier/tie-down belt assembly may comprise at least two carriers, each formed by at least one fixing element 4*a*, and at least one tether and/or belt formed by at least fixing element 4*a*, as illustrated in particular in FIG. 2B.

In this respect, the straps can, independently of one another, each be attached and/or fastened with their one end to the, in particular, upper shoulder region of the upper body protective garment 2*a* at least on the edge side and/or at least in the edge region of the textile sheet material 3*a*, 3*b* and/or be detachably and/or reversibly connectable thereto.

In particular, the carriers can, independently of one another, each be attached and/or fastened and/or detachably and/or reversibly connected to the retaining and/or belt strap, in particular in its rear area, with their other end. The carriers can be attached to the belt strap with one end converging in the manner of a Y-shaped design.

Similarly, the tether and/or belt may at least partially encircle and/or span the front and/or rear upper body portion, preferably the front and/or rear lower body portion of the upper body portion when connected (or closed).

As far as the carrier/restraining strap unit is further concerned, it can be formed in the front upper body area, in particular in the front lower body section of the upper body area, in particular releasably and/or reversibly connectable and/or closable. Corresponding connecting means 10*a* can be used for this purpose (cf. e.g., FIG. 2A and FIG. 2B).

In this context, the retaining and/or belt strap in the front upper body area, in particular in the front lower body section of the upper body area, can be formed with the textile sheet material 3*a* in a releasable and/or reversibly fixable manner, preferably by means of corresponding connecting means 10*a*. For this purpose, it can equally also be provided that the textile sheet material 3*a* itself is equipped with connecting means 11*a* preferably releasably and/or reversibly connectable thereto and/or compatible therewith. Accordingly, it can behave according to the invention in particular in such a way that the holding or belt strap is designed on the one hand to be closable, so to speak, like a belt as well as on the other hand to be releasably or reversibly connectable with the textile sheet material 3*a* in the upper body region, in particular in the front lower abdominal section, in particular on the basis of corresponding connecting means 10*a*, 11*a*.

In particular, the retaining or belt strap can also be designed to be (width-)adjustable.

Furthermore, FIG. 3A and FIG. 3B show another embodiment according to the invention, according to which the lower body protective garment 2*b* comprises a tether unit formed by the fixing elements 4*b* (i.e., formed by at least one fixing element 4*b*) and/or comprising the fixing elements 4*b*. In this regard, the tether unit may be disposed in the waistband region of the lower body protective garment 2*b*. In this regard, the tether unit may at least partially encompass and/or span the front and/or rear lower body region, preferably the front and/or rear waistband portion of the lower body region. In particular, the tether unit may act as a belt, so to speak, so as to ensure a correspondingly secure fit also of the lower body protective garment 2*b*. In general, the tether unit may be designed to be closable via corresponding connecting means 10*b*. Similarly, using corresponding connecting means 10*b*, 11*b*, the tether unit can be formed with the lower body protective garment 2*b* in a preferably releasable and/or reversible manner. In this respect, corresponding compatible connecting means 11*b* may be used on the lower body protective garment. In addition, the retaining strap unit can also be designed to be (width-)adjustable.

As equally illustrated in FIG. 3A and FIG. 3B, according to a further embodiment according to the invention, it may also be provided that the lower body protective garment 2*b* comprises at least two crotch straps each formed by at least one fixing element 4*b*. In this respect, the crotch straps can extend, independently of one another, in each case from the front hip and/or thigh region, in particular via the genital region, along the crotch region to the rear of the retaining strap unit and can be releasably and/or reversibly connected to the retaining strap unit in the rear region of the retaining strap unit. For this purpose, corresponding connecting means 11*b* may be inserted or present. In this regard, the tether unit of the lower body protective garment 2*b* can be equipped with connecting means 11*b* that are preferably releasably and/or reversibly connectable thereto and/or compatible therewith.

Furthermore, with regard to the neck and/or head protective garment 2*c*, FIG. 4A illustrates a further embodiment according to the invention, according to which namely the neck and/or head protective garment 2*c* has, preferably in the region (C-i) of the neck in particular on the front side, at least one connecting means (neck and/or head protective connecting means) 11*c*, preferably for in particular subsequent attachment to and/or putting on (donning) over an outer garment and/or over the neck and/or head region and/or for closing the neck and/or head protective garment 2*c*.

In this context, the neck and/or head protective garment 2*c* can be equipped with at least one connecting means (neck and/or head protective connecting means) 11*c*, in particular in the area of its respective (end) sections that are assigned to each other in the application and/or wearing state and/or overlap in the application and/or wearing state. For this purpose, the connecting means 11*c* of one (end) section can preferably be designed to be detachably and/or reversibly connectable and/or compatible with the connecting means 11*c* of the other (end) section of the head protective garment (e.g., hook and loop element).

FIG. 4A also shows an embodiment according to the invention, according to which the neck or head protective garment 2*c* is equipped with at least one adjustment device 16, in particular a width adjustment device. Hereby, in particular the circumference or the length of the neck or head protective garment 2*c* can be adjusted or preset for optimal adjustment or positioning, in particular with respect to the neck and/or neck area.

Furthermore, FIG. 1A and FIG. 2A show a further embodiment according to the invention, according to which the upper body protective garment 2*a* has at least one fastening device 15 which is preferably of flat design, in particular for fastening external devices, objects or the like. In this context, the fastening device 15 may be arranged in the region of the frontal torso, in particular in the lower abdominal and/or abdominal region, of the upper body protective garment 2*a*. In this respect, the fastening device 15 may comprise or consist of at least one connecting means. In this regard, the connecting means may in particular be designed to be detachably and/or reversibly connectable to connecting means compatible therewith, which are located, for example, on objects to be fastened. For example, the connecting element of the fastening device 15 may be in the form of a fluff element or the like.

Further details on the textile sheet material with ballistic protection function are given below:

In the context of the present invention, the sheet material 3*a*, 3*b*, 3*c*, 3*d*, 3*e* in particular comprises or consists of at least one textile sheet ballistic protective material (fragment protective material) 5. For this purpose, reference can be made to FIG. 5 by way of illustration. The ballistic protective material 5 for the respective sheet material 3*a*, 3*b*, 3*c*, 3*d*, 3*e* can in particular be formed independently of one another in accordance with the present specifications.

The ballistic protective material 5 serves in particular to provide a corresponding splinter, puncture or cut protection, preferably a splinter protection or a ballistic protection function. The purposeful use of a ballistic protective material based on a textile also ensures, within the scope of the present invention, a high degree of pliability and flexibility of the sheet material 3*a*, 3*b*, 3*c*, 3*d*, 3*e* or of the protective clothing unit 1 according to the invention as a whole, which leads to a further improved wearing comfort with correspondingly good manageability.

According to the invention, the ballistic protective material 5 may in particular be in the form of a textile knitted fabric and/or be formed as a textile knitted fabric.

In the context of the present invention, it has been found advantageous that the ballistic protective material 5 is in the form of a knitted fabric and/or a knitted fabric, in particular a warp knitted fabric and/or a weft knitted fabric, preferably in the form of a knitted fabric.

In this context, it may be provided in particular that the ballistic protective material 5 is in the form of knitted and/or warp-knitted fabrics, in particular warp-knitted fabrics and/or weft-knitted fabrics, preferably knitted fabrics.

In accordance with the invention, it may also be the case that the ballistic protective material 5 is in the form of a knitted fabric or is present as a knitted fabric or is a knitted fabric in each case.

In the context of the present invention, the specific design of the ballistic protective material 5 as a textile knitted fabric, in particular as a knitted fabric, is associated with the central advantage that this provides a particularly elastic, stretchable and flexible sheet material, which benefits the wearing comfort in a corresponding manner. In addition, the protective function is further improved, since the material can adapt particularly well to the body areas or sections to be protected, which also improves the overall coverage of the areas or sections in question.

According to the invention, it can also be provided that the ballistic protective material 5, in particular in the form of a textile knitted fabric, preferably a knitted fabric, has at least one ribbed structure in each case. Furthermore, it can also be provided in this context according to the invention that the ballistic protective material 5, in particular in the form of a textile knitted fabric, preferably a knitted fabric, in each case has rib-like elevations, preferably longitudinal ribs, in particular wherein the rib-like elevations, in particular the longitudinal ribs, run and/or are arranged at least substantially rectilinearly and/or parallel to one another. This can also improve the mechanical or ballistic stability or integrity of the ballistic protective material 5.

Furthermore, the ballistic protective material 5, in particular in the form of a knitted fabric, preferably a knitted fabric, may in each case have at least one binding element different from a mesh, preferably a plurality of binding elements different from a mesh. In this context, the binding element may be selected from the group consisting of loop, float (floatation), weft, partial weft and standing yarn, preferably loop and float (floatation). In particular, the binding element in this context may thus be or be present in the form of a handle and/or a float (floatation). The use of special binding elements, as defined above, leads to a further increase in the mechanical or ballistic stability or integrity of the ballistic protective material 5.

According to the invention, it is advantageous if the ballistic protective material 5, in particular in the form of a textile knitted fabric, preferably a knitted fabric, has a weight per unit area, in particular determined in accordance with DIN EN 12 127:1997, of at least 80 g/m$^2$, in particular at least 100 g/m$^2$, preferably at least 150 g/m$^2$, preferably at least 200 g/m$^2$, particularly preferably at least 220 g/m$^2$.

In particular, the ballistic protective material 5, especially in the form of a textile knitted fabric, preferably a knitted fabric, may have a weight per unit area, in particular determined in accordance with DIN EN 12 127:1997, of not more than 1,000 g/m$^2$, especially not more than 750 g/m$^2$, preferably not more than 500 g/m$^2$, preferably not more than 350 g/m$^2$, especially preferably not more than 305 g/m$^2$.

In general, the ballistic protective material 5, in particular in the form of a textile knitted fabric, preferably a knitted fabric, may have a basis weight, in particular determined in accordance with DIN EN 12 127:1997, in the range from 80 g/m$^2$ to 1,000 g/m$^2$, in particular in the range from 100 g/m$^2$ to 750 g/m$^2$, preferably in the range from 150 g/m$^2$ to 500 g/m$^2$, preferably in the range from 200 g/m$^2$ to 350 g/m$^2$, particularly preferably in the range from 220 g/m$^2$ to 305 g/m$^2$.

The setting of a special weight per unit area, as described above, leads to a further optimization of the protective function, in particular also against the penetration or impact of splinters or fragments, while at the same time also ensuring a high flexibility or pliability of the sheet material, which leads in particular to an improvement in wearing comfort and optimum coverage of the body areas to be protected.

According to the invention, it can also be provided that the ballistic protective material 5, in particular in the form of a textile knitted fabric, preferably a knitted fabric, has a thickness in the range from 0.1 mm to 50 mm, in particular 0.2 mm to 25 mm, preferably 0.3 mm to 15 mm, preferably 0.4 mm to 10 mm, particularly preferably 0.5 mm to 5 mm, most preferably 0.6 mm to 2.5 mm. This can also further increase stability.

In addition, it can be provided according to the invention that the ballistic protective material 5, in particular in the form of a textile knitted fabric, preferably a knitted fabric, has a number and/or density of wales (wales/cm) in the range from 2 to 25 wales/cm, in particular in the range from 4 to wales/cm, preferably in the range from 5 to 17 wales/cm, preferably in the range from 6 to 15 wales/cm. In particular, the ballistic protective material 5, especially in the form of a textile knitted fabric, preferably a knitted fabric, can have a number and/or density of stitch rows (stitch rows/cm) in the range from 2 to 40 stitch rows/cm, especially in the range from 5 to 30 stitch rows/cm, preferably in the range from 8 to 25, preferably in the range from 10 to 23 stitch rows/cm. This is because the setting of a special density of mesh bars or of mesh rows is also of great importance, in particular also with regard to a further improvement of the stability underlying the ballistic protective material 5.

According to the invention, the ballistic protective material 5, in particular in the form of a textile knitted fabric, preferably a knitted fabric, can be a material selected from the group of ultra high molecular weight polyethylene (UHMW-PE); aramids, in particular para-aramids; polybenzazoles, in particular poly(phenylene-2,6-benzobisoxazole) (PBO); high-performance polyethylene (HPPE or high-performance polyethylene); high-performance polyesters (high-strength polyesters) and combinations or mixtures thereof, preferably selected from the group of ultra-high molecular weight polyethylene (UHMW-PE); aramides, in particular para-aramides, and combinations or mixtures thereof, particularly preferably ultra-high molecular weight polyethylene (UHMW-PE).

According to the invention, the ballistic protective material 5, in particular in the form of a textile knitted fabric, preferably a knitted fabric, has or consists of a material in the form of ultra-high molecular weight polyethylene (UHMW-PE) and/or aramid, in particular para-aramid, particularly preferably in the form of ultra-high molecular weight polyethylene (UHMW-PE). Consequently, according to the invention, the ballistic protective material 5 may in particular comprise or consist of ultra-high molecular weight polyethylene or UHMW-PE and/or aramid or para-aramid, particularly preferably ultra-high molecular weight polyethylene (UHMW-PE).

In this context, the material may be present or formed as yarn, in particular multifilament yarn, thread, twisted yarn or the like.

In particular, the material may be present in each case in an amount in the range from 5% to 100% by weight, in particular from 10% to 100% by weight, preferably from 30% to 100% by weight, preferably from 50% to 100% by weight, based on the ballistic protective material 5.

According to a preferred embodiment according to the invention, it can be provided in particular that the ballistic protective material 5, in particular in the form of a textile knitted fabric, preferably a knitted fabric, is formed at least substantially entirely from ultrahigh molecular weight polyethylene (UHMW-PE) or consists thereof, in particular wherein the ultrahigh molecular weight polyethylene (UHMW-PE) is present and/or formed as a yarn, in particular a multifilament yarn, thread, twisted yarn or the like.

In particular, the ballistic protective material 5, especially in the form of a textile knitted fabric, preferably a knitted fabric, may consist of and/or be formed from ultra-high molecular weight polyethylene (UHMW-PE), especially wherein the ultra-high molecular weight polyethylene (UHMW-PE) is present and/or formed as a yarn, especially a multifilament yarn, thread, twisted yarn or the like. In other words, according to the invention, it may in particular be provided that the ballistic protective material 5 contains the UHMW-PE in an amount of 100% by weight.

The purposeful use of UHMW-PE further improves the properties of the ballistic protective material 5. This is because UHMW-PE exhibits very high stability, which leads to a corresponding improvement in the splinter, puncture or cut protection properties, in particular the ballistic protection function. In addition, UHMW-PE also exhibits high resistance, and in particular to moisture and UV radiation, so that the materials thus provided also exhibit correspondingly high resistance.

In a non-restrictive manner, corresponding yarns, in particular multifilament yarns, threads, twisted yarns or the like based on commercially available products, such as those available under the name Dyneema®, such as Dyneema® SK75 (220 dtex) or Dyneema® BK75 (220 dtex), can be used.

In general, the yarn, in particular the multifilament yarn, the thread, the twisted yarn or the like, can have a titre (fineness, yarn count), in particular determined in accordance with DIN EN ISO 2060, of at least 100 dtex, in particular at least 125 dtex, preferably at least 150 dtex, preferably at least 170 dtex, particularly preferably at least 180 dtex, very particularly preferably at least 190 dtex. In particular, the yarn, in particular the multifilament yarn, the thread, the twisted yarn or the like can have a titre (fineness, yarn count), in particular determined in accordance with DIN EN ISO 2060, of at most 500 dtex, in particular at most 400 dtex, preferably at most 350 dtex, preferably at most 300 dtex, particularly preferably at most 275 dtex, very particularly preferably at most 250 dtex. According to the invention, it is particularly intended that the yarn, in particular the multifilament yarn, the thread, the twisted yarn or the like have a linear density (fineness, yarn count), in particular determined according to DIN EN ISO 2060, in the range from 100 dtex to 500 dtex, in particular in the range from 125 dtex to 400 dtex, preferably in the range from 150 dtex to 350 dtex, preferably in the range from 170 dtex to 300 dtex, particularly preferably in the range from 180 dtex to 275 dtex, very particularly preferably in the range from 190 dtex to 250 dtex. According to the invention, the term "titre" is also referred to synonymously as fineness or yarn fineness.

Furthermore, it can be provided according to the invention that the yarn, in particular the multifilament yarn, the thread, the twisted yarn or the like have a diameter of at least 25 μm, in particular at least 50 μm, preferably at least 80 μm, preferably at least 100 μm, particularly preferably at least 120 μm.

In particular, the yarn, especially the multifilament yarn, thread, twine or the like may have a diameter of at most 800 μm, especially at most 600 μm, preferably at most 500 μm, preferably at most 400 μm, especially preferably at most 250 μm.

According to the invention, it may also be provided that the yarn, in particular the multifilament yarn, thread, twist or the like has a diameter in the range from 25 μm to 800 μm, in particular in the range from 50 μm to 600 μm, preferably in the range from 80 μm to 500 μm, preferably in the range from 100 μm to 400 μm, particularly preferably in the range from 120 μm to 250 μm.

In general, the diameter can be determined by methods known to the skilled person, for example on the basis of optical or light microscopic or electrode microscopic methods.

According to one embodiment according to the invention, the yarn used for the ballistic protective material 5 may be a multifilament yarn.

In this context, the multifilament yarn multifilament yarn may be formed of or consist of 5 to 500 individual filaments, in particular 10 to individual filaments, preferably 20 to 300 individual filaments, preferably 40 to 200 individual filaments, more preferably 60 to 160 individual filaments, very particularly preferably 80 to 120 individual filaments.

In particular, the multifilament yarn can be twisted in the Z-direction or in the S-direction, preferably in the Z-direction. In this context, the multifilament yarn can have a yarn and/or thread twist, in particular yarn twist, in the range of 60 T/m to 140 T/m (turns per meter), in particular in the range of 65 T/m to 120 T/m, preferably in the range of 70 T/m to 100 T/m, preferably in the range of 75 T/m to 90 T/m, in the Z-direction or in the S-direction, preferably in the Z-direction, in particular determined according to DIN EN ISO 2061.

In particular, continuous filaments can be used for the multifilament yarn, which can be UHMW-PE single or continuous filaments. This leads to a further improvement in the stability of the multifilament yarn obtained.

As far as the target or purpose-oriented use of the aforementioned multifilament yarn is concerned, the underlying yarn twist leads to a further optimization of the ballistic stability and thus of the ballistic protection properties as a whole. In this context, the special twist leads to particularly good stability properties, especially since an improved distribution of kinetic energy introduced by the impact or action of splinters or fragments is ensured within the multifilament yarn. In addition, this also further improves pliability and flexibility.

In this context, it is preferred according to the invention if the multifilament yarn is at least substantially formed from or consists of UHMW-PE or is present as UHMW-PE multifilament yarn. In this context, it may be provided according to the invention that the individual filaments are each formed of or consist of or are formed from UHMW-PE. In particular, the individual filaments may be present as UHMW-PE individual filaments.

As illustrated in FIG. 5, it can be provided according to the invention that the sheet material 3*a*, 3*b*, 3*c*, 3*d*, 3*e*, has a plurality of layers of the ballistic protective material 5. In this way, the stability can be further increased or specifically adjusted. The layers of the ballistic protective material 5 can be formed independently of one another in accordance with the present specifications.

In particular, the sheet material 3*a*, 3*b*, 3*c*, 3*d*, 3*e* each have at least 2, in particular at least 3, preferably at least 4, preferably at least 6, layers of the ballistic protective material 5. In this context, it is particularly provided according to the invention that the layers of the ballistic protective material 5 are arranged in a stack or plane-parallel to one another (cf. also FIG. 5). In accordance with the invention, it may in particular be the case that the sheet material 3*a*, 3*b*, 3*c*, 3*d*, 3*e* each has at most 26, in particular at most 24, preferably at most 22, preferably at most 20, particularly preferably at most 18, layers of the ballistic protective material 5. In particular wherein the layers of the ballistic protective material 5 are arranged in a stack and/or plane-parallel to each other. In general, the sheet material 3*a*, 3*b*, 3*c*, 3*d*, 3*e* can each have a number of layers of the ballistic protective material 5 in the range from 1 to 26, in particular 2 to 24, preferably 3 to 22, preferably 4 to 20, particularly preferably 6 to 18, in particular wherein the layers of the ballistic protective material 5 are arranged in stack form and/or plane-parallel to one another.

In this context, moreover, at least two, in particular successive, layers of the ballistic protective material 5 can be oriented or arranged in a twisted manner with respect to the (main) sheet of the respective layers and/or with respect to the course of the yarn and/or thread and/or with respect to the orientation of the stitches underlying the knitted fabric (in particular in the form of the respective rows of stitches or wales) and/or with respect to the rib-like elevations (in particular in the form of longitudinal ribs) of the respective layers, in particular with an angle in the range from 45° to 90°, preferably with an angle of about 45° or about 90°.

According to the invention, it can also be provided that the protective clothing unit 1 (or the corresponding textile sheet material 3*a*, 3*b*, 3*c*, 3*d*, 3*e*) has an equal or different (different from each other), preferably a different (different from each other), number of layers of the ballistic protective material 5, in particular wherein the layers of the ballistic protective material 5 are arranged in a stack and/or plane-parallel to each other (i.e. also in the respective areas or sections). Consequently, the protective function provided can be predetermined or set on a region- or section-by-section basis. In this way, within the scope of the present invention, for example, particularly endangered areas of the body, in which injuries can have particularly serious effects (such as for example for the area of the frontal torso with the relevant lower abdominal area), can be particularly protected. In contrast, increased mobility can be provided individually for other areas, such as for the arms or the arm area, which benefits freedom of movement and tactile work accordingly.

In this light, it can be provided according to the invention in particular that the upper body protective garment 2*a*, in particular the upper body area, (or the corresponding textile sheet material 3*a*) has in areas and/or sections an identical or different (from one another), preferably a different (from one another), number of layers of the ballistic protective material 5, in particular wherein the layers of the ballistic protective material 5 are arranged in a stack and/or plane-parallel to one another.

In particular, the upper body protective garment 2*a*, especially the upper body area, (resp. the corresponding textile sheet material 3*a*) in the region (A-i) of the front (front-side) torso, (A-ii) of the front-side shoulders, (A-vi) of the side torso and/or (A-vii) of the upper and/or rear-side shoulders can have a number of layers of the ballistic protective material 5 in the range from 4 to 26, in particular 8 to 24, preferably 10 to 22, preferably 12 to 20, particularly preferably 14 to 18, in particular wherein the layers of the ballistic protective material 5 are arranged in a stack and/or plane-parallel to one another.

In particular, the upper body protective garment 2*a*, especially the upper body area, (resp. the corresponding textile sheet material 3*a*) in the region (A-i) of the front (front-side) torso, (A-ii) of the front shoulders, (A-vi) of the side torso, (A-vii) of the upper and/or rear shoulders and/or (A-ix) of the side hip can have a number of layers of the ballistic protective material 5 in the range from 4 to 26, in particular 8 to 24, preferably 10 to 22, preferably 12 to 20, particularly preferably 14 to 18, in particular wherein the layers of the ballistic protective material 5 are arranged in a stack and/or plane-parallel to one another.

According to the invention, it can also be provided that the upper body protective garment 2*a*, in particular the upper body area, (resp. the corresponding textile sheet material 3*a*) in the region (A-iii) of the front-side and/or side arms and/or optionally (A-ix) of the lower inner-side arm and/or wrist region has a number of layers of the ballistic protective material 5 in the range from 2 to 14, in particular 4 to 12, preferably 6 to 10, in particular wherein the layers of the ballistic protective material 5 are arranged in a stack and/or plane-parallel to one another.

In a corresponding manner, it can also be provided in the context of the present invention that the lower body protective garment 2*b*, in particular the lower body region, (or the corresponding textile sheet material 3*b*) has, in regions and/or sections, an identical (identical) or different (different from one another), preferably an identical (identical), number of layers of the ballistic protective material 5, in particular wherein the layers of the ballistic protective material 5 are arranged in a stack and/or plane-parallel to one another.

In this respect, the lower body protective garment 2*b*, in particular the lower body area, (or the corresponding textile sheet material 3*b*) may have a number of layers of ballistic protective material 5 in the range of 2 to 14, in particular 4 to 12, preferably 6 to 10, in particular wherein the layers of ballistic protective material 5 are arranged in a stack and/or plane-parallel to each other.

Similarly, the lower body protective garment 2*b*, in particular the lower body area, (resp. the corresponding textile sheet material 3*b*) in the area (B-i) of the front upper legs, (B-ii) of the front hip, (B-iii) of the genital area, (B-vi) of the front knee area, (B-vii) of the lateral upper legs (thighs) and/or (B-viii) of the lateral hip have a number of layers of the ballistic protective material 5 in the range from 2 to 14, in particular 4 to 12, preferably 6 to 10, in particular wherein the layers of the ballistic protective material 5 are arranged in a stack and/or plane-parallel to one another.

Moreover, the lower body protective garment 2*b*, in particular the lower body area, (resp. the corresponding textile sheet material 3*b*) in the region (B-i) of the front upper legs, (B-ii) of the front hip, (B-iii) of the genital region, (B-vii) of the lateral upper legs (thighs) and/or (B-viii) of the lateral hip can have a number of layers of the ballistic protective material 5 in the range from 2 to 14, in particular 4 to 12, preferably 6 to 10, in particular wherein the layers of the ballistic protective material 5 are arranged in a stack and/or plane-parallel to one another.

In a corresponding manner, neck and/or head protective garment 2*c*, 2*d*, 2*e*, in particular the neck and/or head area, (or the corresponding textile sheet material 3*c*, 3*d*, 3*e*) can have, in areas and/or sections, an identical (identical) or different (different from each other), preferably an identical (identical), number of layers of ballistic protective material 5, in particular wherein the layers of ballistic protective material 5 are arranged in a stack and/or plane parallel to each other.

In this context, the neck and/or head protective garment 2*c*, 2*d*, 2*e*, in particular the neck and/or head area, (or the corresponding textile sheet material 3*c*, 3*d*, 3*e*) may have a number of layers of ballistic protective material 5 in the range of 2 to 14, in particular 4 to 12, preferably 6 to 10, in particular wherein the layers of ballistic protective material 5 are arranged in a stack and/or plane parallel to each other.

In addition, the neck and/or head protective garment 2*c*, 2*d*, 2*e*, in particular the neck and/or head area, (resp. the corresponding textile sheet material 3*c*, 3*d*, 3*e*) in the area (C-i) of the neck, in particular the frontal neck, and/or (C-ii) of the head, if necessary (C-iii) of the lateral neck, if necessary (C-iv) of the rear neck, if necessary (C-v) of the lower part of the face, if necessary (C-vi) of the cheek area, if necessary (C-vii) of the mouth, optionally (C-viii) of the nose, optionally (C-ix) of the forehead and/or optionally (C-x) of the top and/or back of the head, have a number of layers of the ballistic protective material 5 in the range from 2 to 14, in particular 4 to 12, preferably 6 to 10, in particular the layers of the ballistic protective material 5 being arranged in a stack and/or plane-parallel to one another.

According to the invention, it is also possible that the neck and/or head protective garment 2*c*, 2*d*, 2*e*, in particular the neck and/or head area, (resp. the corresponding textile sheet material 3*c*, 3*d*, 3*e*) in the region (C-i) of the neck in particular on the front side and/or (C-ii) of the head, (C-iii) of the lateral neck and/or (C-iv) of the neck on the rear side have a number of layers of the ballistic protective material 5 in the range from 2 to 14, in particular 4 to 12, preferably 6 to 10, in particular wherein the layers of the ballistic protective material 5 are arranged in a stack and/or plane-parallel to one another.

As similarly exemplarily illustrated in FIG. 5, it can also be provided according to the invention that the layers of the ballistic protective material 5 are joined to one another, preferably joined to one another at the edges, in particular by means of a first joint 17. In this case, the joint can be made in particular by means of sewing and/or knitting, welding, gluing or the like, preferably by means of sewing and/or knitting.

In accordance with an embodiment according to the invention, it can also be provided that the layers of the ballistic protective material 5 are in the form of at least two ballistic protective units (ballistic protective packages) 6, 7, in particular a first ballistic protective unit (first ballistic protective package) 6 and a second ballistic protective unit (second ballistic protective package) 7, as likewise illustrated in FIG. 5. The ballistic protective packages 6, 7 for the respective sheet material 3*a*, 3*b*, 3*c*, 3*d*, 3*e* can be formed independently of one another in accordance with the present specifications.

In particular, the layers of ballistic protective material 5 can be divided between at least two ballistic protective units (ballistic protective packages) 6, 7, in particular a first ballistic protective unit (first ballistic protective package) 6 and a second ballistic protective unit (second ballistic protective package) 7, see FIG. 5.

According to the invention, it can also be provided that the layers of the ballistic protective material arranged in a common ballistic protective unit 6, 7 form respective stacks, in particular wherein the layers arranged in the first ballistic protective unit 6 form a first stack on the one hand and the layers arranged in the second ballistic protective unit 7 form a second stack on the other hand, in particular wherein the layers of the respective stacks are joined to one another, in particular by means of a respective first joint 17, preferably joined to one another at the edges, in particular by means of sewing and/or knitting, welding, gluing or the like, preferably by means of sewing and/or knitting.

Thus, the textile sheet material 3*a*, 3*b*, 3*c*, 3*d*, 3*e* can itself have a modular structure based on respective ballistic protective units 6, 7. For further embodiments of the ballistic protective units 6, 7, reference can also be made to the explanations that follow in the further course. This can also simplify the configuration and manufacture of the textile sheet material 3*a*, 3*b*, 3*c*, 3*d*, 3*e*, after which the respective ballistic protective units 6, 7 are combined or connected to form the textile sheet material.

As far as the textile sheet material 3*a*, 3*b*, 3*c*, 3*d*, 3*e* as such is further concerned, it may comprise a first textile covering material (outer fabric, outer material) 8 (cf. also FIG. 5).

In this respect, the first textile covering material 8 may be arranged on the outer side of the textile sheet material 3*a*, 3*b*, 3*c*, 3*d*, 3*e*. Consequently, according to the invention, it behaves in particular in such a way that the first textile covering material 8 is arranged or positioned on the side of the textile sheet material 3*a*, 3*b*, 3*c*, 3*d*, 3*e* facing away from the support in the wearing or application state.

According to the invention, the first textile covering material 8 can be arranged in a stack and/or plane-parallel to the ballistic protective material 5, in particular to the layers of the ballistic protective material 5.

According to the invention, the first textile covering material 8 can be formed as knitted fabric, in particular knitted or knitted fabrics; woven fabric; scrim or textile composite, in particular as knitted or woven fabric, preferably as woven fabric. In the context of the present invention, it has proved advantageous if the first textile covering material 8 is formed as a woven fabric in the form of ripstop, twill or canvas, in particular in the form of ripstop. This results in particular in a high (further) tear resistance of the first textile cover material 8.

As far as the first textile cover material 8 is further concerned, the weight per unit area in this respect can generally vary in large ranges. According to the invention, it has proven advantageous if the first textile cover material 8 has a basis weight, in particular determined in accordance with DIN EN 12 127:1997, in the range from 50 g/m$^2$ to 800 g/m$^2$, in particular in the range from 60 g/m$^2$ to 600 g/m$^2$, preferably in the range from 80 g/m$^2$ to 500 g/m$^2$, preferably in the range from 90 g/m$^2$ to 300 g/m$^2$.

In general, the first textile cover material 8 may have a tear strength, in particular determined according to DIN EN ISO 13934-1:2013, of at least 100 Newton, in particular at least 200 Newton, preferably at least 300 Newton, preferably at least 500 Newton. In addition, the first textile covering material 8 can have a tear strength, in particular determined in accordance with DIN EN ISO 13934-1:2013, in the range from 100 Newton to 1,500 Newton, in particular in the range from 200 Newton to 1,300 Newton, preferably in the range from 300 Newton to 1,200 Newton, preferably in the range from 500 Newton to 1,100 Newton.

Within the scope of the present invention, it may be provided that the first textile covering material 8 is a material selected from the group of natural materials and synthetic materials, in particular selected from the group of cotton; wool; linen; polyesters; polyolefins; polyvinyl chloride; polyvinylidene chloride; acetates, in particular cellulose acetates; triacetates, in particular cellulose triacetates; aramides, in particular meta- and/or para-amides; optionally modified and/or regenerated celluloses; polyacryl; polyamide; polyvinyl alcohol; polyurethanes; polyvinyl esters; modified and/or regenerated celluloses, in particular viscose; and mixtures or combinations thereof, preferably selected from the group consisting of modified and/or regenerated celluloses, in particular viscose; aramids, in particular meta- and/or para-amides; polyamide and mixtures or combinations thereof.

In this context, the material in question may be in the form of yarn, thread, twine or the like. In principle, the previously mentioned materials can also be in the form of fibers.

According to the invention, the first textile covering material 8 may be of a flame-retardant and/or flame-retardant and/or fire-resistant and/or flame-resistant design. In this respect, the first textile covering material 8 may comprise at least one flame-retardant and/or flame-retardant and/or fire-resistant and/or flame-resistant material, in particular in the form of or as a component of a yarn and/or twisted yarn and/or thread.

In this context, it may be provided, for example, that the fire-resistant and/or flame-retardant material is at least one aramid, in particular meta-aramid and/or para-aramid, and/or a modified and/or regenerated cellulose.

In general, the first textile cover material 8 may comprise the flame-retardant and/or flame-retardant and/or fire-resistant and/or flame-retardant material in an amount in the range of 1% by weight to 100% by weight, in particular 2% by weight to 95% by weight, preferably 5% by weight-to 90% by weight, based on the textile cover material 8. For example, materials based on commercially available products, such as those available under the name Lenzing®, such as Lenzing® FR in particular, can be used in this respect.

Furthermore, the first textile cover material 8 may be antistatic. Generally, the first textile cover material 8 may comprise at least one antistatic material, particularly in the form of or as a component of a yarn and/or twine and/or thread. In this respect, the first textile cover material 8 may comprise the antistatic material in an amount ranging from 0.1% to 10% by weight, in particular from 0.2% to 5% by weight, preferably from 0.5% to 3% by weight, based on the textile cover material 8.

Furthermore, the first textile cover material 8 may have an oleophobic and/or hydrophobic finish and/or coating.

In addition, it can be equally provided according to the invention that the textile sheet material 3*a*, 3*b*, 3*c*, 3*d*, 3*e* each has at least a second textile cover material (inner fabric, inner material) 9 (cf. FIG. 5). In this respect, the second textile cover material 9 may be arranged on the inner side of the textile sheet material 3*a*, 3*b*, 3*c*, 3*d*, 3*e*. In other words, according to the invention, it behaves in particular in such a way that the second textile cover material 9 is arranged or positioned on the side of the textile sheet material 3*a*, 3*b*, 3*c*, 3*d*, 3*e* facing the support in the wearing or application state.

According to the invention, in particular (C) the neck and/or head protective garment 2*c*, 2*d*, 2*e* and/or the sheet material 3*c*, 3*d*, 3*e* relating thereto can be equipped and/or provided with the second textile cover material 9. This can further increase the wearing comfort, in particular also in the case that the neck and/or head protective garment 2*c*, 2*d*, 2*e* is worn directly on the skin.

According to the invention, (A) the upper body protective garment 2*a* and/or the textile sheet material 3*a* relating thereto and/or (B) the lower body protective garment 2*b* and/or the textile sheet material 3*b* relating thereto may also be equipped and/or provided with the second textile cover material 9. According to the invention, however, it can also be provided that (A) the upper body protective garment 2*a* and/or the textile sheet material 3*a* relating thereto and/or (B) the lower body protective garment 2*b* and/or the textile sheet material 3*b* relating thereto are not equipped and/or provided with the second textile cover material 9, in particular since the aforementioned garments 2*a*, 2*b* are preferably arranged or worn on an outer garment or the like (and thus primarily do not come into contact with the skin). In this way, in particular, the (sheet) weight of the garments 2*a*, 2*b* can also be reduced.

In general, the second textile cover material 9 may be arranged in a stacked and/or plane-parallel manner with respect to the ballistic protective material 5, in particular with respect to the layers of the ballistic protective material 5.

In particular, it can be provided according to the invention that the second textile covering material 9 is formed as knitted fabric, in particular knitted fabrics; woven fabric; scrim or textile composite, in particular as knitted fabric, preferably as knitted fabrics.

According to the invention, the second textile cover material 9 may have a basis weight, in particular determined according to DIN EN 12 127:1997, in the range from 50 $g/m^2$ to 700 $g/m^2$, in particular in the range from 60 $g/m^2$ to 600 $g/m^2$, preferably in the range from 80 $g/m^2$ to 500 $g/m^2$, preferably in the range from 90 $g/m^2$ to 400 $g/m^2$, particularly preferably in the range from 150 $g/m^2$ to 375 $g/m^2$.

In accordance with the invention, it can also behave in particular in such a way that the second textile cover material 9 is a material selected from the group of natural materials and synthetic materials, in particular selected from the group of cotton; wool; linen; polyesters; polyolefins, polyvinyl chlorides; polyvinylidene chlorides; acetates, in particular cellulose acetates; triacetates, in particular cellulose triacetates; acrylics, in particular modacrylics and polyacrylics; polyamides; polyvinyl alcohols; polyurethanes; polyvinyl esters; viscose; and mixtures or combinations thereof, preferably selected from the group of natural materials and acrylics.

In this context, it behaves in particular such that the material is formed as yarn, thread, twine or the like.

Furthermore, it can be provided according to the invention that the second textile cover material 9 is antistatic. In this context, the second textile covering material 9 may comprise at least one antistatic material, in particular in the form of or as a component of a yarn and/or twisted yarn and/or thread.

In particular, the second textile cover material 9 may comprise the antistatic material in an amount in the range of 0.1% to 10% by weight, in particular 0.2% to 5% by weight, preferably 0.5% to 3% by weight, based on the second textile cover material 9.

In addition, the following should also be mentioned with respect to the first textile cover material 8 or the second textile material 9:

According to the invention, it may be provided that, as illustrated in FIG. 5, the first textile cover material 8 is joined to the ballistic protective material 5, in particular to at least one layer of the ballistic protective material 5, preferably joined at the edge, in particular by means of sewing and/or knitting, welding, gluing or the like, preferably by means of sewing and/or knitting. Similarly, it can be provided according to the invention that the second textile covering material 9 is connected to the ballistic protective material 5, in particular to at least one layer of the ballistic protective material 5, preferably connected at the edge, in particular by means of sewing and/or knitting, welding, gluing or the like, preferably by means of sewing and/or knitting.

As shown in FIG. 5, it can also behave in such a way that the first textile covering material 8 is associated with the first ballistic protective unit 6 and/or is a component thereof. In this context, the first textile covering material 8 may be arranged as the outermost and/or first layer in a stacked manner and/or plane-parallel to the layers of the ballistic protective material 5 of the first ballistic protective unit 6. In this context, it can likewise be provided that the first textile covering material 8 and the first layer of the ballistic protective material 5 of the first ballistic protective unit 6 adjoining the first textile covering material 8 is designed to be larger in area and/or to protrude at the edges from the subsequent layers of the ballistic protective material 5 of the first ballistic protective unit 6.

In this respect, it may likewise be provided that the layer adjoining the first textile covering material 8 is connected, in particular sewn, to the subsequent layers of the ballistic protective material 5 via at least one first connection 17.

Furthermore, the second textile cover material 9 can be assigned to the second ballistic protective unit 7 or be a component thereof (cf. FIG. 5). In this respect, the second textile cover material 9 can be stack-shaped and/or plane-parallel to the layers of the ballistic protective material 5 of the second ballistic protective unit 7 as the innermost and/or last layer.

Similarly, in this context, the second textile covering material 9 and the first layer of the ballistic protective material 5 of the second ballistic protective unit 7 adjoining the second textile covering material 9 can be designed to be larger in area and/or to protrude at the edges from the subsequent layers of the ballistic protective material 5 of the second ballistic protective unit 7.

In this respect, it may likewise be provided that the layer adjoining the second textile covering material 9 is connected, in particular sewn, to the subsequent layers of the ballistic protective material 5 via at least one first connection 17.

As equally illustrated in FIG. 5, it is particularly provided according to the invention that the first ballistic protective unit 6 and the second ballistic protective unit 7 are arranged with respect to each other in such a way that the first textile covering material 8 is arranged on the outside of the textile sheet material 3*a*, 3*b*, 3*c*, 3*d*, 3*e* and that the second textile covering material 9 is arranged on the inside of the textile sheet material 3*a*, 3*b*, 3*c*, 3*d*, 3*e*.

According to the invention, in the first ballistic protective unit 6, the edge-side region of the first textile covering material 8 and of the first layer of the ballistic protective material 5 adjoining the first textile covering material 8 can be wrapped around the subsequent layers of the ballistic protective material 5, in particular in such a way that the subsequent layers of the ballistic protective material 5 are bordered or enclosed on the edge side by the first textile covering material 8 and, if appropriate, by the first layer of the ballistic protective material 5 adjoining the first textile covering material 8.

In particular, it can also be provided in this context that, in the second ballistic protective unit 7, the edge-side region of the second textile covering material 9 and of the first layer of the ballistic protective material 5 adjoining the second textile covering material 9 is wrapped around the subsequent layers of the ballistic protective material 5, in particular in such a way that the subsequent layers of the ballistic protective material 5 are enclosed or surrounded by the second textile covering material 9 and the first layer of the ballistic protective material 5 adjoining the second textile covering material 9.

According to the invention, it can also be provided that the first textile covering material 8 and the first layer of the ballistic protective material 5 adjoining the first textile covering material 8, on the one hand, are connected, in particular sewn, to the second textile covering material 9 and the first layer of the ballistic protective material 5 adjoining the second textile covering material 9, on the other hand, on the inside in the contacting edge region via at least one second connection 18.

In this way, with respect to the textile sheet material 3*a*, 3*b*, 3*c*, 3*d*, 3*e*, the result is, so to speak, an internal and protected connection, in particular of the ballistic protective units 6, 7 or a corresponding seam, which is not subjected to any tensile stress or at most to a reduced tensile stress in the event of an explosion. In addition, the joint or seam as such is protected by the overlying ballistic protective elements. The comprehensive arrangement of the larger-area layer of the ballistic protective material in relation to the other ballistic protective layers results not least in lateral splinter protection in the edge region or at the hem edge of the textile sheet material 3*a*, 3*b*, 3*c*, 3*d*, 3*e*.

FIG. 2B as well as FIG. 2C illustrate a further embodiment according to the invention, according to which namely the upper body protective garment 2*a* can be equipped or is equipped with at least one additional and/or supplementary and/or retrofittable ballistic protective element (ballistic protective element of the upper body protective garment) 12*a*. In this respect, the ballistic protective element 12*a* may be connectable (attachable) to the inner side of the textile sheet material 3*a* of the upper body protective garment 2*a*, in particular in a detachable and/or reversible manner, or may be connected (attached), in particular in a detachable and/or reversible manner. Similarly, the ballistic protective element 12*a* can be arrangeable (positionable) or arranged (positioned) in the upper body area comprising at least (A-iii) the front and/or side arms.

In general, the ballistic protective material 12*a* may comprise at least one textile sheet-like ballistic protective material (fragment protective material) 5, as previously defined.

In this context, it may be provided that the ballistic protective element 12*a* comprises a plurality of layers of the ballistic protective material 5. In this context, the layers of the ballistic protective material 5 may be arranged in a stack and/or plane-parallel to one another. In accordance with the invention, it has proven advantageous in this regard if the ballistic protective element 12*a* has a number of layers of the ballistic protective material 5 in the range from 1 to 12, in particular 2 to 11, preferably 5 to 10. In this respect, the layers of the ballistic protective material 5 can be arranged in a stack and/or plane-parallel to one another.

In accordance with the invention, it may also be the case that the layers of ballistic protective material 5 are joined together. In this respect, for example, a cross-stitched joint or the like can be realized, as schematically illustrated in FIG. 2C.

Generally, the ballistic protective element 12*a* may include at least one textile cover material. In this respect, the covering material may be arranged on the outer side and/or inner side of the ballistic protective element 12*a*. Similarly, the textile covering material may preferably be joined to the ballistic protective material 5 on the edge side, in particular sewn, preferably by means of an edging tape or the like.

In principle, materials based on the first textile material 8 or the second textile material 9 previously mentioned for the textile sheet material 3*a*, 3*b*, 3*c*, 3*d*, 3*e* are generally considered for the covering material of the respective ballistic protective elements. According to the invention, it is preferred in this case if the textile covering material of the ballistic protective element 12*a* is formed on the basis of or in the form of the second textile covering material 9.

As for the upper body protective garment 2*a* in this context, this may be designed in particular to accommodate corresponding ballistic protective elements 12*a* for the left and right arm areas.

In general, the ballistic protective element 12*a* may comprise at least one connecting means 14*a*, in particular on the side facing the textile sheet material 3*a* in the state of use. In this respect, reference may also be made to FIG. 2C. The connecting means 14*a* is designed in particular for preferably releasable and/or reversible connection to the textile sheet material 3*a*, in particular to the inner side of the textile sheet material 3*a* and/or to the second covering material 9 of the textile sheet material 3*a*, preferably via at least one further connecting means (further connecting means of the textile sheet material of the upper body protective garment 2*a*) 13*a* which can be connected to the connecting means 14*a* in a preferably releasable and/or reversible manner and/or is compatible therewith. With regard to the further connecting means of the textile sheet material 13*a*, reference may also be made to FIG. 2B. In general, the connecting means 14*a* and 13*a* may be formed, for example, as hook and/or loop elements for forming a hook-and-loop fastener.

Furthermore, the lower body protective garment 2*b* can also be equipped or provided with at least one additional and/or supplementary and/or retrofittable ballistic protective element (ballistic protective element of the lower body protective garment) 12*b*. In this regard, reference may be made to FIG. 3B and FIG. 3C for illustrative purposes.

In this context, the ballistic protective element 12*b* can be connected (fastened) to the inner side of the textile sheet material 3*b* of the lower body protective garment 2*b*, in particular in a detachable and/or reversible manner, or in particular in a detachable and/or reversible manner. Similarly, in this context, the ballistic protective element 12*b* can be arrangeable (positionable) or arranged (positioned) in the lower body region comprising at least (B-i) the front upper legs (thighs), optionally (B-ii) the front hip, optionally (B-iii) the genital region and optionally (B-iv) the front knee region.

In general, it may be provided that the ballistic protective element 12*b* comprises at least one textile sheet-like ballistic protective material (fragment protective material) 5, as previously defined.

In accordance with the invention, it can be equally provided in this context that the ballistic protective element 12*b* has a plurality of layers of the ballistic protective material 5, in particular wherein the layers of the ballistic protective material 5 are arranged in a stack and/or plane-parallel to one another. In the context of the present invention, it has proved advantageous if the ballistic protective element 12*b* has a number of layers of the ballistic protective material 5 in the range from 1 to 12, in particular 2 to 11, preferably 5 to 10, in particular wherein the layers of the ballistic protective material 5 are arranged in a stack and/or plane-parallel to one another.

In general, the layers of ballistic protective material 5 may be joined together, in particular by cross-stitching or the like (cf. FIG. 3C).

Furthermore, in this context, it may also be provided within the scope of the present invention that the ballistic protective element 12*b* comprises at least one textile covering material. In this context, the covering material may be arranged on the outer side and/or inner side of the ballistic protective element 12*b*. In addition, the textile covering material can preferably be connected to the ballistic protective material 5 on the edge side, in particular sewn, preferably by means of a binding tape or the like.

As far as the covering material of the ballistic protective element 12*b* is concerned, reference can be made to the explanations concerning the aforementioned ballistic protective element 12*a*, which apply accordingly.

For example, the lower body protective garment may be equipped with three ballistic protective elements 12*b*, for example for the right and left thigh areas and for the genital area. For this purpose, for example, the ballistic protective elements 12*b* shown in FIG. 3C can be used.

The ballistic protective element 12*b* can also have at least one connecting means 14*b*, in particular on the side facing the textile sheet material 3*b* in the application state, as shown in FIG. 3C. In this case, the connecting means 14*b* is in particular for preferably releasable and/or reversible connection to the textile sheet material 3*b* of the lower body protective garment 2*b*, in particular the inner side of the textile sheet material 3*b* and/or the second covering material 9 of the textile sheet material 3*b*, preferably via at least one further connecting means (further connecting means of the textile sheet material of the lower body protective garment 2*b*) 13*b*, which can be preferably releasably and/or reversibly connected to the connecting means 14*b* and/or is compatible therewith. In particular, the connecting means 13*b*, 14*b* may be formed on the basis of hook and/or loop elements, in particular for providing a hook-and-loop fastener.

Furthermore, as far as the textile sheet material in general is concerned, the following statements are also relevant:

As far as the textile sheet material 3*a*, 3*b*, 3*c*, 3*d*, 3*e* is concerned, it has a particularly high shatter protection or ballistic protection: Thus, according to the invention, it can be provided that the textile sheet material 3*a*, 3*b*, 3*c*, 3*d*, 3*e* each has a shatter and/or ballistic protection value $V_{50}$, determined according to STANAG 2920, of at least 150 m/s, in particular at least 200 m/s, preferably at least 250 m/s, preferably at least 300 m/s. In particular, the textile sheet material 3*a*, 3*b*, 3*c*, 3*d*, 3*e* may each have a shatter and/or ballistic protection value $V_{50}$, determined according to STANAG 2920, in a range from 150 m/s to 650 m/s, in particular in a range from 200 m/s to 600 m/s, preferably in a range from 250 m/s to 550 m/s, preferably in a range from 300 m/s to 500 m/s.

The shatter and/or ballistic protection values $V_{50}$, determined in accordance with STANAG 2920, refer in particular to a determination using projectiles in the form of FSPs with a projectile weight of 1.1 g (1.1 FSP) (with FSP=Fragment Simulating Projectile). The ballistic protection values $V_{50}$ given in accordance with STANAG 2920 are determined in particular at a temperature of (20±2) ° C. and in particular at a relative humidity of (65±4) %. A projectile of the 1.1 g FSP type simulates heavier fragments in particular, and is also particularly suitable for assessing a multilayer structure. The $V_{50}$ value refers in particular to the velocity (m/s) at which, using a defined projectile and selected (test) material, there is a probability of perforation or penetration of the material caused by the projectile of 0.5 (with 1 equal to maximum probability) or of 50%. For further explanations, reference can be made to the corresponding standard according to STANAG 2920.

According to the invention, there is thus a high overall level of ballistic protection against splinters, so that on this basis increased protection against splinters is provided, particularly with regard to blasting devices or the like (and with regard to both primary and secondary splinters).

According to the invention, it may also be provided that the textile sheet material 3*a*, 3*b*, 3*c*, 3*d*, 3*e* is each gas-permeable, preferably air-permeable.

In particular, the textile sheet material 3*a*, 3*b*, 3*c*, 3*d*, 3*e* can each have a gas permeability, preferably air permeability, in particular determined according to DIN EN ISO 9237 (i.e. DIN EN ISO 9237:1995-12) and/or in particular determined at 100 Pa, of at least 20 $l/m^2*s$, in particular at least 50 $l/m^2*s$, preferably at least 100 $l/m^2*s$, preferably at least 200 $l/m^2*s$, particularly preferably at least 300 $l/m^2*s$, very particularly preferably at least 400 $l/m*s.^2$ In addition, the textile sheet material 3*a*, 3*b*, 3*c*, 3*d*, 3*e* can each have a gas permeability, preferably air permeability, in particular determined in accordance with DIN EN ISO 9237 and/or in particular determined at 100 Pa, in the range from 20 $l/m^2*s$ to 3,500 $l/m^2*s$, in particular in the range from 50 $l/m^2*s$ to 3,000 $l/m^2*s$, preferably in the range from 100 $l/m^2*s$ to 2,500 $l/m^2*s$, preferably in the range from 200 $l/m^2*s$ to 2,000 $l/m^2*s$, particularly preferably in the range from 300 $l/m^2*s$ to 1,500 $l/m^2*s$, very particularly preferably in the range from 400 $l/m^2*s$ to 1,000 $l/m^2*s$.

In addition, it can be provided in accordance with the invention that the textile sheet material 3*a*, 3*b*, 3*c*, 3*d*, 3*e* is designed to be permeable to water vapor in each case. In particular, the textile sheet material 3*a*, 3*b*, 3*c*, 3*d*, 3*e* can each have a water vapor transmission resistance Ra under steady-state conditions, in particular determined in accordance with ISO 11092, of at most 30 ($m^2$*Pascal)/Watt, in particular at most 20 ($m^2$*Pascal)/Watt, preferably at most 15 ($m^2$*Pascal)/Watt.

This ensures a particularly high level of wearer comfort, as body perspiration can be effectively wicked away.

The water vapor transmission resistance $R_{et}$ can be measured in particular according to international standard ISO 11092 of February 1994 or according to the identical DIN EN 31 092:1993 ("Textiles—physiological effects, measurement of thermal and water vapor transmission resistance under steady-state conditions (sweating guarded-hotplate test)").

In the context of the present invention, it has also proved advantageous if the protective garments 2*a*, 2*b*, 2*c*, 2*d*, 2*e*, in particular the upper body protective garment 2*a* and/or the lower body protective garment 2*b* and/or the neck and/or head protective garment 2*c*, 2*d*, 2*e*, independently of one another, have at least substantially no rigid and/or hard and/or firm and/or rigid and/or stiff and/or semi-firm and/or inflexible ballistic protection components, in particular no ballistic protection plates and/or armor or the like. This ensures, in particular, a high flexibility or pliability of the ballistic protection garments and thus of the protective clothing unit according to the invention as a whole, and this with simultaneously reduced (sheet) weights.

In accordance with the first aspect of the present invention, the present invention also relates to a ballistic body protective garment 2*a*, 2*b*, in particular with splinter, puncture and/or cut protection, preferably with splinter protection, in particular for use as protective equipment, preferably for the military and/or civilian sector, preferably for in particular subsequent application to and/or donning (putting on) over an outer garment,

- wherein the body protective garment 2*a*, 2*b* is configured for ballistic protection of a body region,
- wherein the body protection garment 2*a*, 2*b* comprises at least one textile sheet material (upper body protective sheet material) (3*a*, 3*b*) with ballistic protection function covering the body area;
- in particular wherein the body protective garment 2*a*, 2*b* is formed in the rear body region at least regionally free of material, preferably at least substantially completely free of material; and
- in particular wherein the body-protective garment 2*a*, 2*b* is equipped with at least one fixing element (body-protective fixing element) 4*a*, 4*b*, preferably for in particular subsequent attachment to and/or putting on (donning) of the body-protective garment 2*a*, 2*b* over an outer garment, in particular in the edge region of the body-protective garment 2*a*, 2*b*.

According to the invention, the body protective garment 2*a* can be designed as a ballistic upper body protective garment 2*a*, in particular with splinter, stab and/or cut protection, preferably with splinter protection;

- wherein the upper body protective garment 2*a* is formed for ballistic protection of an upper body portion comprising at least (A-i) the front (front side) torso, (A-ii) the front shoulders and (A-iii) the front and/or side arms, the upper body protective garment 2*a* comprising at least one textile sheet material (upper body protective surface material) 3*a* having ballistic protection function and covering the upper body portion;
- wherein the upper body protective garment 2*a* is formed in the rear region of the torso at least regionally free of material, preferably at least substantially completely free of material; and
- wherein the upper body protective garment 2*a* is equipped with at least one fixing element (upper body protective fixing element) 4*a*, preferably for in particular subsequent attachment to and/or putting on (donning) of the upper body protective garment 2*a* over an outer garment, in particular jacket, in particular in the edge region of the upper body protective garment 2*a*.

According to a further embodiment, the body protective garment 2*b* may be designed as a ballistic lower body protective garment 2*b*, in particular with splinter, stab and/or cut protection, preferably with splinter protection;

- wherein the lower body protective garment 2*b* is configured for ballistic protection of a lower body region comprising at least (B-i) the front upper legs (thighs), optionally (B-ii) the front hip, and optionally (B-iii) the genital region;
- wherein the lower body protective garment 2*b* comprises at least one textile sheet material (lower body protective sheet material) 3*b* having a ballistic protective function and covering the lower body region;
- wherein the lower body protective garment 2*b* is formed in the rear region of the upper legs at least regionally free of material, preferably at least substantially completely free of material; and
- wherein the lower body protective garment 2*b* has at least one fixing element (lower body protection fixing element) 4*b* in the rear region of the upper legs, preferably for in particular subsequently attaching to and/or putting on (donning) the lower body protective garment 2*b* over an outer garment, in particular trousers.

In this regard, the body protective garments 2*a*, 2*b* may be combined to form a modular ballistic protective garment unit 1, in particular as previously defined.

In accordance with this aspect of the present invention, the present invention also relates to an upper body protective garment 2*a*, in particular with splinter, puncture and/or cut protection, preferably with splinter protection, in particular for use as protective equipment, preferably for the military and/or civilian sector, preferably for in particular subsequent application to and/or donning (putting on) over an outer garment,

- wherein the upper body protective garment 2*a* is formed for ballistic protection of an upper body portion comprising at least (A-i) the front (front side) torso, (A-ii)

the front shoulders and (A-iii) the front and/or side arms, the upper body protective garment 2*a* comprising at least one textile sheet material (upper body protective surface material) 3*a* having ballistic protection function and covering the upper body portion;

wherein the upper body protective garment 2*a* is formed in the rear region of the torso at least regionally free of material, preferably at least substantially completely free of material; and wherein the upper body protective garment 2*a* is equipped with at least one fixing element (upper body protective fixing element) 4*a*, preferably for in particular subsequent attachment to and/or putting on (donning) of the upper body protective garment 2*a* over an outer garment, in particular jacket, in particular in the edge region of the upper body protective garment 2*a*.

Furthermore, in accordance with this aspect of the present invention, the present invention also relates to a lower-body protective garment 2*b*, in particular with splinter-, puncture and/or cut protection, preferably with splinter protection, in particular for use as protective equipment, preferably for the military and/or civilian sector, preferably for in particular subsequent application to and/or donning (putting on) over an outer garment, wherein the lower body protective garment 2*b* is formed for ballistic protection of a lower body region comprising at least (B-i) the front upper legs (thighs), optionally (B-ii) the front hip and optionally (B-iii) the genital region, wherein the lower body protective garment 2*b* comprises at least one textile sheet material (lower body protective sheet material) 3*b* having a ballistic protection function and covering the lower body region;

wherein the lower body protective garment 2*b* is formed in the rear region of the upper legs at least regionally free of material, preferably at least substantially completely free of material; and wherein the lower body protective garment 2*b* has at least one fixing element (lower body protective fixing element) 4*b* in the rear region of the upper legs, preferably for in particular subsequently attaching to and/or putting on (donning) the lower body protective garment 2*b* over an outer garment, in particular trousers.

For further details, reference can also be made to the above statements.

It is also an object of the present invention—according to a further aspect of the present invention—to use the modular ballistic protective clothing unit according to the invention, as previously defined, for providing and/or increasing splinter-, puncture and/or cut protection, preferably splinter protection, preferably for the military and/or civilian sector, preferably for, in particular, subsequently attaching to and/or putting on (donning) the protective clothing unit over an outer garment.

In this context, the protective clothing unit 1 may comprise several, in particular at least two, preferably at least three, independent ballistic protective garments 2*a*, 2*b*, 2*c*, 2*d*, 2*e*, in particular each with splinter, puncture and/or cut protection, preferably each with splinter protection, which are in particular separate from one another and/or separately present, preferably assigned to one another and/or matched to one another and/or complementary to one another.

A further object of the present invention—according to yet another aspect of the present invention—is also the method of manufacturing a modular ballistic protective clothing unit 1, as previously defined, and/or a body protective garment 2*a*, 2*b*, as previously defined, and/or an upper body protective garment 2*a*, as previously defined, and/or an under protective garment 2*b*, as previously defined, wherein the protective clothing unit 1 and/or the body protective garment 2*a*, 2*b* and/or the upper body protective garment 2*a* and/or the lower body protective garment 2*b* is equipped with a textile sheet material 3*a*, 3*b* with ballistic protective function, the textile sheet material 3*a*, 3*b* being produced thereby, in that layers of a ballistic protective material 5 are divided into a first ballistic protective unit 6 and a second ballistic protective unit 7 and are in each case arranged in a stack and/or plane-parallel and are joined to one another, the first ballistic protective unit 6 and the second ballistic protective unit 7 being joined to one another, in particular being joined on the inside at the edges.

Furthermore, in particular also subject of the present aspect of the invention is the method for manufacturing a modular ballistic protective clothing unit 1, as previously defined, and/or a body protective garment 2*a*, 2*b*, as previously defined, and/or an upper body protective garment 2*a*, as previously defined, and/or an under protective garment 2*b*, as previously defined, in particular the method as previously stated, wherein the protective clothing unit 1 and/or the body protective garment 2*a*, 2*b* and/or the upper body protective garment 2*a* and/or the lower body protective garment 2*b* is equipped with a textile sheet material 3*a*, 3*b* with ballistic protective function, the textile sheet material 3*a*, 3*b* being produced thereby, in that layers of a ballistic protective material 5 are divided into a first ballistic protective unit 6 and a second ballistic protective unit 7 and are in each case arranged in a stack and/or plane-parallel and are connected to one another, in particular at the edges, via a first connection 17, wherein in the first ballistic protective unit 6 and in the second ballistic protective unit 7 one of the respective outer layers of the ballistic protective material 5 is formed to be larger in area than the other layers of the ballistic protective material 5, in particular so that it protrudes at the edge, wherein the first ballistic protective unit 6 and the second ballistic protective unit 7 are each provided with a textile covering material 8, 9 on the respective larger-area layer of the ballistic protective material 5, wherein the textile covering material 8, 9 corresponds in area at least substantially to the respective larger-area layer of the ballistic protective material 5, in particular in such a way that the textile covering material 8, 9 projects equally at the edges, wherein the respective edge formed by the textile covering material 8, 9 and the layer of the ballistic protective material 5 having a larger area is folded over around the remaining layers of the ballistic protective material 5, in particular so that the respective remaining layers of the ballistic protective material 5 are enclosed by the edge, wherein the first ballistic protective unit 6 and the second ballistic protective unit 7 are arranged in such a way that the respective textile covering material 8, 9 are arranged outwardly and the respective layers of the ballistic protective material 5 are arranged relative to each other, and the first ballistic protective unit 6 and the second ballistic protective unit 7 being connected, in particular being connected at the edge in the contacting edge region on the inside via a second connection 18.

As far as the process according to the invention is concerned, the previously stated process features or steps are purely illustrative and illustrative with regard to their sequence, so that the stated sequence is not to be understood as limiting with regard to the process sequence.

Further embodiments, variations, modifications, particular features and advantages of the present invention are readily apparent to those skilled in the art upon reading the description and can be implemented without departing from the scope of the present invention.

REFERENCE LIST

1 modular ballistic protective clothing unit
2*a* ballistic upper body protective garment
2*b* ballistic lower body protective garment
2*c* ballistic neck and/or head protective garment in the form of a neck protector
2*d* ballistic neck and/or head protective garment in the form of a neck protector
2*e* ballistic neck and/or head protective garment in the form of a balaclava with protection of the lower part of the face
3*a* textile sheet material (upper body protective surface material)
3*b* textile sheet material (lower body protective surface material)
3*c* textile sheet material (neck and/or head protective surface material) with ballistic protection function for a neck and/or head protective garment in the form of a neck protector
3*d* textile sheet material (neck and/or head protective surface material) with ballistic protection function for a neck and/or head protective garment in the form of a neck and face protector
3*e* textile sheet material in the form of a balaclava
4*a* fixing element (upper body protective fixing element)
4*b* fixing element (lower body protective fixing element)
5 Ballistic protective material (fragment protective material)
6 first ballistic protective unit
7 second ballistic protective unit
8 first textile cover material
9 second textile cover material
10*a,b* connecting means of the fixing elements
11*a,b* flat material bonding agent
11*c* connecting means of neck and/or head protector
12*a* ballistic protective element of the upper body protective garment
12*b* ballistic protective element of the lower body protective garment
13*a* further joining means of the textile sheet material
14*a,b* linking means
15 fixing device
16 adjustment device
17 first connection
18 second connection

The invention claimed is:

1. A modular ballistic protective clothing unit with at least one of splinter, stab or cut protection as a protective equipment for the military or civilian sector for subsequent fitting on or putting on over an outer garment, wherein the protective clothing unit comprises at least three independent ballistic protective clothing garments each with splinter, stab or cut protection, wherein the protective clothing unit comprises the following protective garments:

(A) an upper body ballistic protective garment with splinter, stab or cut protection;

wherein the upper body protective garment is formed for ballistic protection of an upper body portion comprising at least the front torso, the front shoulders and the front or side arms, wherein the upper body protective garment comprises at least one textile sheet material having ballistic protection function covering the upper body portion;

wherein the upper body protective garment is formed free of material at least in regions in the rear region of the torso; and wherein the upper body protective garment is equipped with at least one fixing element for mounting or fitting the upper body protective garment over an outer garment;

(B) a ballistic lower body protective garment;

wherein the lower body protective garment is designed for ballistic protection of a lower body area comprising at least the front upper legs, wherein the lower body protective garment comprises at least one textile sheet material with ballistic protection function covering the lower body area;

wherein the lower body protective garment is formed free of material at least in regions in the back side region of the upper legs; and wherein the lower-body protective garment has, in the rear region of the upper legs, at least one fixing element for subsequent attachment to or fitting of the lower-body protective garment over an outer garment;

and (C) at least one ballistic neck or head protective garment with splinter, stab or cut protection, wherein the neck or head protective garment is designed for ballistic protection of a neck or head region, which comprises at least the neck on the front side or the head, wherein the neck or head protective garment has at least one textile sheet material with ballistic protective function, which covers the neck or head region;

wherein the upper body protective garment, the lower body protective garment and the neck or head protective garment, independently of each other, each have no rigid, hard, fixed, rigid, stiff, and inflexible ballistic protective components in the form of ballistic protective plates, and wherein the respective sheet material of the ballistic upper body protective garment, of the ballistic lower body protective garment and of the at least one ballistic neck or head protective garment each comprise at least one textile sheet-like ballistic protective material, wherein the ballistic protective material in the form of a textile knitted consists of ultra-high molecular weight polyethylene.

2. The protective clothing unit according to claim 1, wherein the textile sheet material covers the upper body region at least substantially completely or at least substantially without interruption or at least substantially continuously or as an at least substantially continuous surface.

3. The protective clothing unit according to claim 1, wherein the upper body protective garment or the lower body protective garment or the neck or head protective garment can beare put on over the outer garment at least substantially independently of one another.

4. The protective clothing unit according to claim 1,
wherein the upper body protective garment or the lower body protective garment, independently of one another, are each held in position on the outer garment by means of the fixing elements; wherein the fixing elements.

5. The protective clothing unit according to claim 1,
wherein the ballistic protective material has in each case a plurality of binding elements different from a mesh; wherein the binding element is present in the form of a handle or float.

6. The protective clothing unit according to claim 5,
wherein the ultra-high molecular weight polyethylene is present or formed as yarn, multifilament yarn, thread, twine or the like.

7. Protective clothing unit according to claim 5,
wherein the sheet material has in each case a plurality of layers of the ballistic protective material, wherein the layers of the ballistic protective material are arranged in stack form or plane-parallel to one another;
wherein the layers of ballistic protective material are in the form of at least two ballistic protective units.

8. The protective clothing unit according to claim 7,
wherein the layers of ballistic protective material are in the form of at least two ballistic protective units in the form of a first ballistic protective unit and a second ballistic protective unit.

9. The protective clothing unit according to claim 7,
wherein the textile sheet material comprises at least one first textile covering material and wherein the textile sheet material comprises at least one second textile covering material, respectively.

10. The protective clothing unit according to claim 9,
wherein the first ballistic protective unit and the second ballistic protective unit are arranged relative to each other such that the first textile covering material is arranged on the outside of the textile sheet material and that the second textile covering material is arranged on the inside of the textile sheet material;
in which, in the first ballistic protective unit, the edge-side region of the first textile covering material and of the first layer of the ballistic protective material adjoining the first textile covering material is folded around the subsequent layers of the ballistic protective material, in such a way that the subsequent layers of the ballistic protective material are bordered at the edges by the first textile covering material and by the first layer of the ballistic protective material adjoining the first textile covering material.

11. The protective clothing unit according to claim 9,
wherein the first ballistic protective unit and the second ballistic protective unit are arranged relative to each other such that the first textile covering material is arranged on the outside of the textile sheet material and that the second textile covering material is arranged on the inside of the textile sheet material;
in which, in the second ballistic protective unit, the edge-side region of the second textile covering material and of the first layer of the ballistic protective material adjoining the second textile covering material is folded around the subsequent layers of the ballistic protective material, in such a way that the subsequent layers of the ballistic protective material are enclosed by the second textile covering material and the first layer of the ballistic protective material adjoining the second textile covering material.

12. The protective clothing unit according to claim 9,
wherein the first ballistic protective unit and the second ballistic protective unit are arranged relative to each other such that the first textile covering material is arranged on the outside of the textile sheet material and that the second textile covering material is arranged on the inside of the textile sheet material;
wherein the first textile covering material and the first layer of the ballistic protective material adjoining the first textile covering material are connected on the one hand to the second textile covering material and the first layer of the ballistic protective material adjoining the second textile covering material on the other hand in the contacting edge region on the inside via at least one second connection.

13. A method for manufacturing a modular ballistic protective clothing unit according to claim 1,
wherein the upper body protective garment and the lower body protective garment are each equipped with a textile surface material with a ballistic protective function,
the textile sheet material being produced thereby in that layers of a ballistic protective material are divided into a first ballistic protective unit and a second ballistic protective unit and are in each case arranged in a stack or plane-parallel and are connected to one another, the first ballistic protective unit and the second ballistic protective unit being connected to one another on the inside at the edge.

14. The method according to claim 13,
the textile sheet material being produced thereby in that layers of a ballistic protective material are divided into a first ballistic protective unit and a second ballistic protective unit and are arranged in each case in a stack or plane-parallel and are connected to one another at the edges via a first connection,
wherein in the first ballistic protective unit and in the second ballistic protective unit one of the respective outer layers of the ballistic protective material is formed to be larger in area than the remaining layers of the ballistic protective material, so that it protrudes at the edge,
wherein the first ballistic protective unit and the second ballistic protective unit are each provided with a textile covering material on the respective larger-area layer of the ballistic protective material, wherein the textile covering material corresponds in area at least substantially to the respective larger layer of the ballistic protective material, such that the textile covering material projects equally at the edge,
wherein the respective edge formed by the textile covering material and the layer of the ballistic protective material having a larger area is folded over around the remaining layers of the ballistic protective material, so that the respective remaining layers of the ballistic protective material are enclosed by the edge,
wherein the first ballistic protective unit and the second ballistic protective unit are arranged such that the respective textile covering material is arranged outwardly and the respective layers of the ballistic protective material are arranged relative to each other, and wherein the first ballistic protective unit and the second ballistic protective unit are connected at the edge in the contacting edge region on the inside via a second connection.

* * * * *